US009745035B2

(12) United States Patent
Hiroshima et al.

(10) Patent No.: US 9,745,035 B2
(45) Date of Patent: Aug. 29, 2017

(54) CONTROL APPARATUS FOR OUTBOARD MOTOR

(71) Applicant: Honda Motor Co., Ltd., Tokyo (JP)

(72) Inventors: Naoki Hiroshima, Saitama (JP); Hiroshi Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/050,391

(22) Filed: Feb. 22, 2016

(65) Prior Publication Data

US 2016/0251066 A1 Sep. 1, 2016

(30) Foreign Application Priority Data

Feb. 27, 2015 (JP) ..... 2015-037814
Feb. 27, 2015 (JP) ..... 2015-037815
Feb. 27, 2015 (JP) ..... 2015-037816

(51) Int. Cl.
*B63H 3/10* (2006.01)
*B63H 3/02* (2006.01)
(Continued)

(52) U.S. Cl.
CPC ..... *B63H 3/10* (2013.01); *B63H 3/02* (2013.01); *B63H 20/00* (2013.01); *B63H 2003/006* (2013.01)

(58) Field of Classification Search
CPC ... B63H 3/10; B63H 3/00; B63H 3/06; B63H 21/22; B63H 3/02; B63J 2099/008; Y02T 70/5272; Y02T 70/542
See application file for complete search history.

(56) References Cited

U.S. PATENT DOCUMENTS 4,436,482 A * 3/1984 Inoue ..... B63H 3/10 416/1
5,413,461 A * 5/1995 Johnsen ..... G01L 5/12 114/144 E
(Continued)

FOREIGN PATENT DOCUMENTS

GB 1210387 * 10/1970
JP 51139097 A * 12/1976
(Continued)

OTHER PUBLICATIONS

Morvillo, Robert A., "Application of Modern Digital Controls to Improve the Operational Efficiency of Controllable Pitch Propellers", SNAME Transactions, vol. 104, 1996, pp. 115 to 136.*
(Continued)

*Primary Examiner* — Behrang Badii
*Assistant Examiner* — David Testardi
(74) *Attorney, Agent, or Firm* — Duft Bornsen & Fettig LLP

(57) ABSTRACT

In an apparatus for controlling an outboard motor mounted on a boat and having an internal combustion engine and a variable pitch propeller, characteristics defining a desired pitch angle of the propeller that makes fuel consumption minimum relative to a navigation speed of the boat are memorized and the pitch angle of the propeller is controlled to the desired pitch angle that is corresponding to the navigation speed detected by a navigation speed detector in accordance with the characteristics.

12 Claims, 22 Drawing Sheets

(51) Int. Cl.
*B63H 20/00* (2006.01)
*B63H 3/00* (2006.01)

(56) References Cited

U.S. PATENT DOCUMENTS

| | | | | | |
|---|---|---|---|---|---|
| 6,287,077 | B1 * | 9/2001 | Muller | B63H 3/02 | 416/157 R |
| 6,379,114 | B1 * | 4/2002 | Schott | B63H 3/10 | 416/1 |
| 6,425,788 | B1 * | 7/2002 | Lindholm | B63H 3/082 | 416/157 R |
| 6,688,926 | B1 * | 2/2004 | Willmot | B63H 3/02 | 416/165 |
| 7,901,258 | B1 * | 3/2011 | McChesney | B63H 20/12 | 440/1 |
| 8,393,924 | B1 * | 3/2013 | Daunais | B63H 3/06 | 440/50 |
| 2007/0134092 | A1 * | 6/2007 | Rosenkranz | B63H 3/00 | 416/1 |
| 2014/0370764 | A1 * | 12/2014 | Kuriyagawa | B63H 3/10 | 440/1 |

FOREIGN PATENT DOCUMENTS

| | | | | | |
|---|---|---|---|---|---|
| JP | 57056639 | A | * | 4/1982 | B63H 3/10 |
| JP | 57090291 | A | * | 6/1982 | B63H 3/10 |
| JP | 58016980 | A | * | 1/1983 | B63H 3/10 |
| JP | 58020592 | A | * | 2/1983 | B63H 3/10 |
| JP | 58063592 | A | * | 4/1983 | B63H 3/10 |
| JP | 58185394 | A | * | 10/1983 | B63H 21/14 |
| JP | 59008590 | A | * | 1/1984 | B63H 3/10 |
| JP | 08239093 | A | * | 9/1996 | |
| JP | 2007509792 | | | 4/2007 | |
| JP | 2013006531 | A | * | 1/2013 | B63H 3/10 |
| JP | 2015006848 | A | * | 1/2015 | |
| WO | WO 8203831 | A1 | * | 11/1982 | B63H 3/10 |
| WO | WO 2010064483 | A1 | * | 6/2010 | B63H 3/10 |

OTHER PUBLICATIONS

JPO machine translation of JP 2013-006531 (original JP document published Jan. 10, 2013).*
JPO machine translation of JP 2015-006848 (original JP document published Jan. 15, 2015).*

* cited by examiner

CONTROL APPARATUS FOR OUTBOARD MOTOR

CROSS-REFERENCE TO RELATED APPLICATION

This application is based upon and claims the benefit of priority from Japanese Patent Applications No. 2015-037814, 2015-037815 and 2015-037816 all filed on Feb. 27, 2015, the contents of which are incorporated herein by reference.

BACKGROUND OF THE INVENTION

Field of the Invention

This invention relates to control apparatus for an outboard motor mounted on a hull of a boat and having a variable pitch propeller with adjustable propeller pitch angle.

Description of Related Art

As a control apparatus of this type is known a conventional apparatus configured to enable switching of operation mode between pilot mode for adjusting propeller pitch (pitch angle) while maintaining high engine idle speed and cruise mode for maintaining a navigation speed of the boat while adjusting engine speed and propeller pitch. For example, an apparatus set out in Japanese Patent Application (filed under PCT) No. 2007-509792 selects in cruise mode power curves (characteristics) corresponding to navigation speed, selects an engine speed based on an intersections between the power curves and fuel consumption lines, and adjusts the propeller pitch to maintain the engine speed.

However, the apparatus of the reference requires selection of the power curve and the engine speed at the time of pitch adjustment in cruise mode, so that the apparatus control configuration is complicated.

SUMMARY OF THE INVENTION

The present invention provides in its first aspect an apparatus for controlling an outboard motor mounted on a hull of a boat and having an internal combustion engine, a throttle lever configured to be operable by an operator to regulate a throttle opening of a throttle valve of the engine, and a propeller powered by the engine, the propeller being a variable pitch propeller whose pitch angle is made variable, comprising: a navigation speed detector configured to detect a navigation speed of the boat; a throttle control unit configured to control the throttle opening of the engine based on an operation amount of the throttle lever; a memory unit configured to memorize characteristics defining a desired pitch angle of the propeller that makes fuel consumption minimum relative to the navigation speed of the boat; and a pitch angle control unit configured to control the pitch angle of the propeller to the desired pitch angle that is corresponding to the navigation speed detected by the navigation speed detector in accordance with the characteristics memorized by the memory unit.

The present invention provides in its second aspect an apparatus for controlling an outboard motor mounted on a hull of a boat and having an internal combustion engine, a throttle lever configured to be manipulated by an operator to regulate a throttle opening of a throttle valve of the engine, and a propeller powered by the engine, the propeller being a variable pitch propeller whose pitch angle is made variable, comprising: a throttle lever operation amount detector configured to detect an operation amount of the throttle lever; a memory unit configured to memorize characteristics defining a desired throttle opening of the engine and a desired pitch angle of the propeller that make fuel consumption minimum relative to the operation amount of the throttle lever; a throttle control unit configured to control the throttle opening of the engine to the desired throttle opening based on the operation amount of the throttle lever detected by the throttle lever operation amount detector in accordance with the characteristics memorized by the memory unit; and a pitch angle control unit configured to control the pitch angle of the propeller to the desired pitch angle based on the operation amount of the throttle lever detected by the throttle lever operation amount detector in accordance with the characteristics memorized by the memory unit.

BRIEF DESCRIPTION OF THE DRAWINGS

The objects, features, and advantages of the present invention will become clearer from the following description of embodiments in relation to the attached drawings, in which.

DETAILED DESCRIPTION OF THE INVENTION

First Embodiment

Now follows an explanation of a first embodiment of the present invention with reference to FIGS. 1 to 10.

Figure 1:
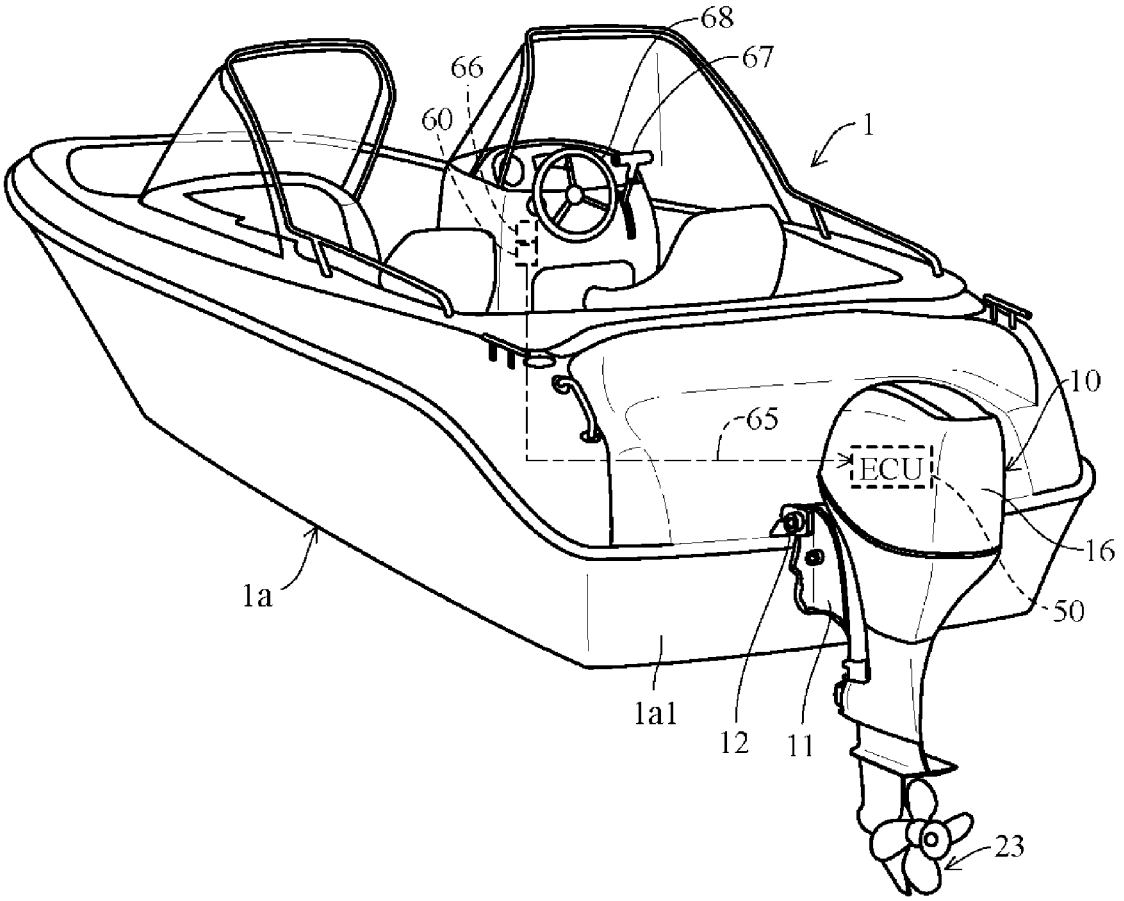
FIG. 1 is a perspective view of a boat on which an outboard motor incorporating a control apparatus according to the first embodiment of the present invention is mounted.
Figure 2:
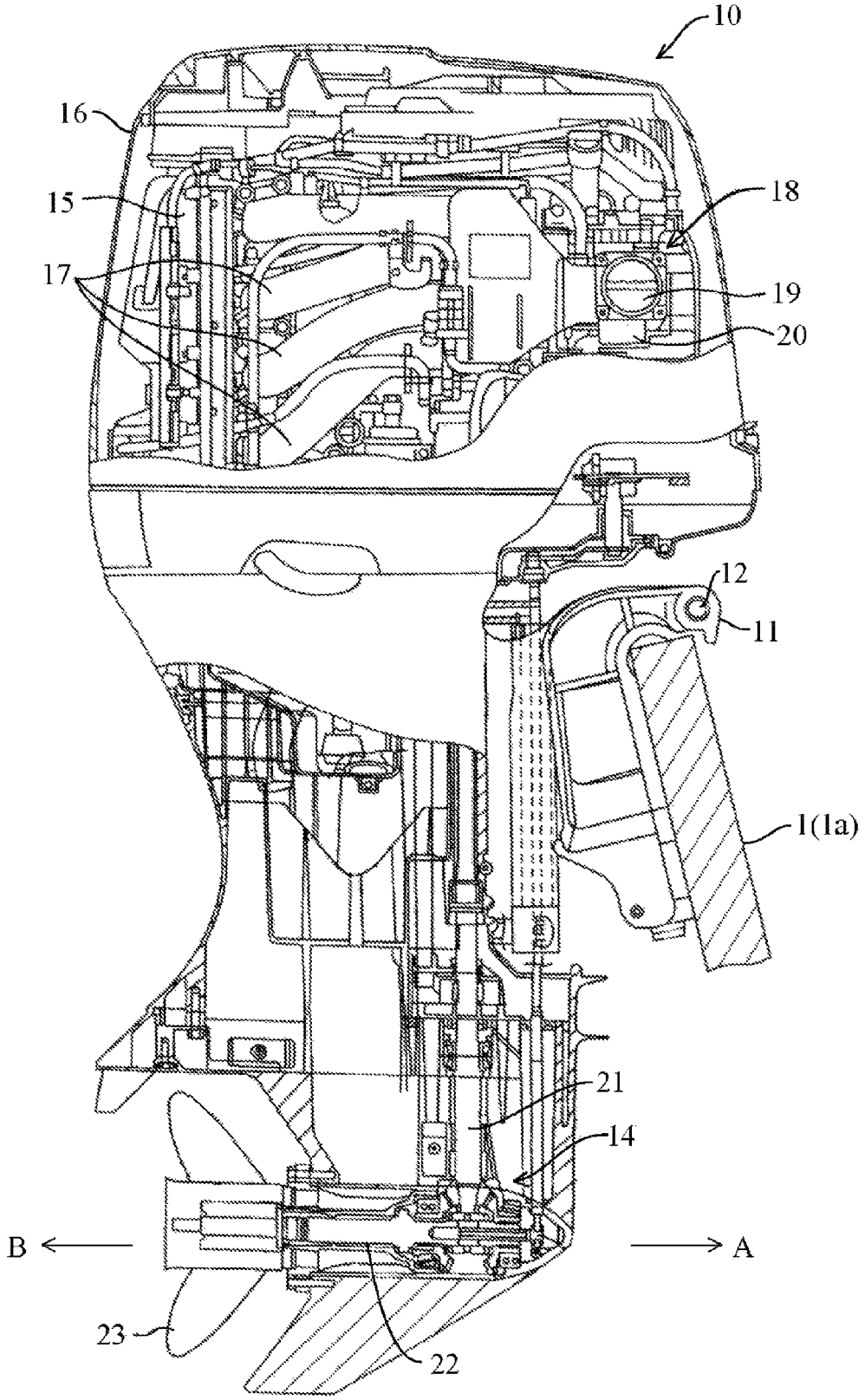
FIG. 2 is a partial sectional view of the outboard motor of FIG. 1.

FIG. 1 is a perspective view of a boat on which an outboard motor incorporating a control apparatus according to the first embodiment of the present invention is mounted, and FIG. 2 is a partial sectional view of the outboard motor of FIG. 1.

As shown in FIGS. 1 and 2, an outboard motor 10 has a stern bracket 11 and a tilting shaft 12, by which it is mounted on a tail, i.e., a stern 1*a*1, of a hull 1*a* of a boat 1. An engine 15 is installed in an upper part of the outboard motor 10. The engine 15 is a spark-ignition, water-cooled gasoline engine with a displacement on the order of, for example, 2,200 cc. The engine 15 is positioned above the water surface and enclosed by an engine cover 16. The outboard motor 10 according to the present embodiment is used in the boat 1 of a pleasure boat or other such small craft.

As shown in FIG. 2, a throttle body 18 is connected to an intake pipe 17 of the engine 15. A throttle valve 19 is provided inside the throttle body 18. An electric motor 20 is attached to the throttle body 18, and air intake volume of the engine 15 is regulated by driving the electric motor 20 to open/close the throttle valve 19. Air regulated by the throttle valve 19 passes through an intake manifold to be mixed with fuel injected from injectors near intake valves, thereby forming air-fuel mixture. Air fuel mixture passes into combustion chambers of individual cylinders of the engine 15, where it is ignited and burned.

A driveshaft 21 is installed under the engine 15 to be rotatable around a vertical axis. The driveshaft 21 is connected to a crankshaft of the engine 15, not shown in the drawings, and power of the engine 15 is transmitted to the driveshaft 21. A hollow propeller shaft 22 is installed under the driveshaft 21 to be rotatable around a horizontal axis. The driveshaft 21 is connected through a shift mechanism 14 to the propeller shaft 22. A propeller 23 comprising multiple blades is attached to a rear end portion of the propeller shaft 22 at regular circumferential intervals.

The shift mechanism 14 includes a clutch and is configured to enable switching of shift position to forward position, reverse position and neutral position. When the shift position is switched to forward position and reverse position, the clutch is engaged and power of the engine 15 is transmitted to the propeller shaft 22. By this, the propeller 23 rotates integrally with the propeller shaft 22 and the outboard motor 10 generates propulsion with respect to the boat 1 in forward direction (direction of arrow A) or reverse direction (arrow B). On the other hand, when shift position switches to neutral position, the clutch is disengaged and power transmission from the engine 15 to the propeller shaft 22 is cut off.

Figure 3:
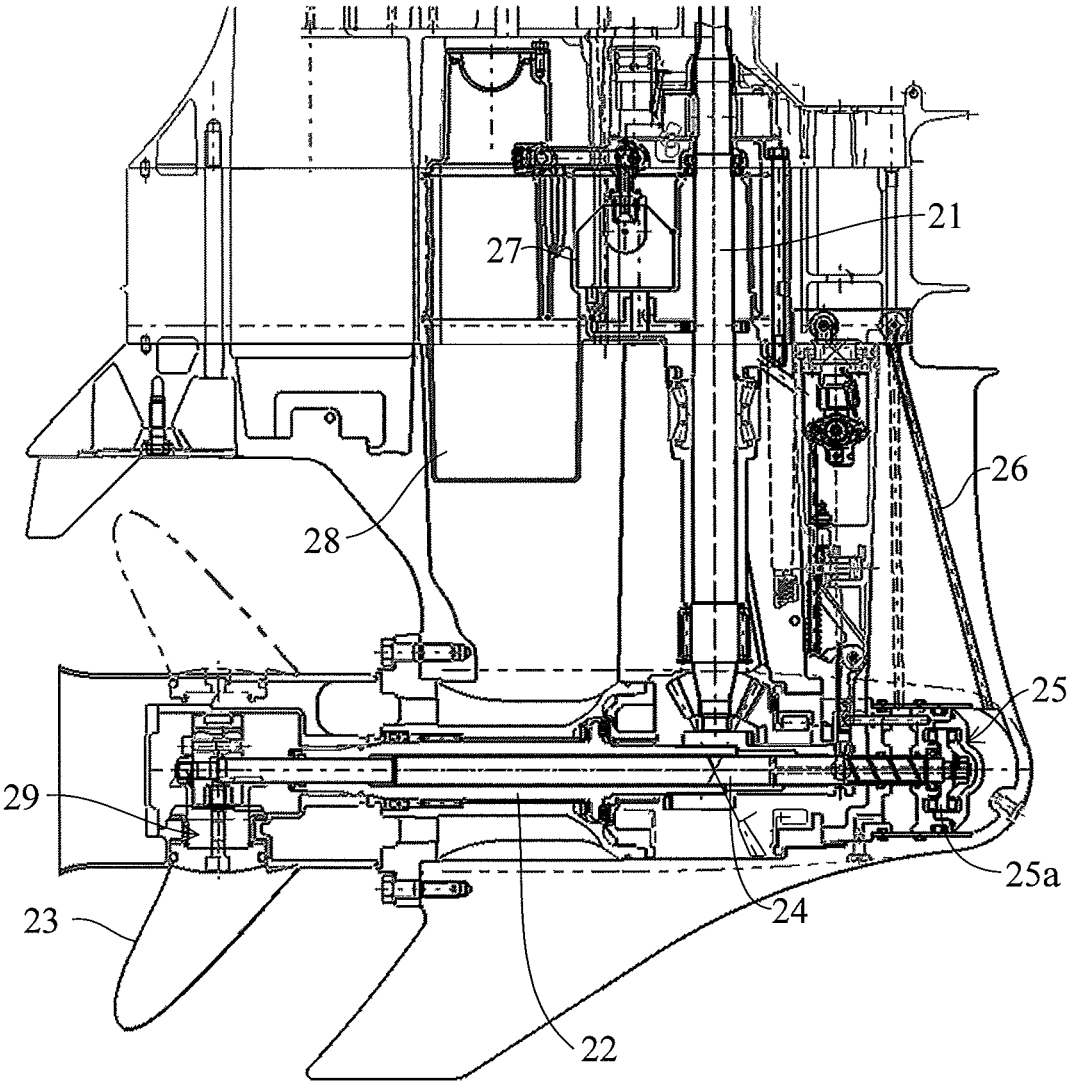
FIG. 3 is an enlarged view of an essential part of the outboard motor of FIG. 2.

FIG. 3 is an enlarged view of an essential part of the outboard motor 10. As shown in FIG. 3, a push-pull rod 24 is installed inside the propeller shaft 22 to be movable axially (forward-backward) inside the propeller shaft. A hydraulic cylinder 25 is provided at a front end portion of the push-pull rod 24 and the push-pull rod 24 constitutes a piston rod of the hydraulic cylinder 25.

Specifically, an oil chamber 250 (see FIG. 5) is formed around the front end portion of the push-pull rod 24, and a piston 25*a* provided at the front end portion of the push-pull rod 24 is installed in the oil chamber 250. The oil chamber facing the piston 25*a* communicates with an oil passage 26, and by driving a hydraulic pump 27, hydraulic pressure is supplied from a hydraulic tank 28 to the oil passage 26. Flow of hydraulic pressure from the oil passage 26 to the hydraulic cylinder 25 (oil chamber facing the piston 25*a*) is controlled by means of a direction switching valve 32 (see FIG. 5), thereby enabling the push-pull rod 24 to be moved forward and backward.

A conversion mechanism 29 for converting forward-backward linear motion of the push-pull rod 24 to rotational motion of the propeller 23 is provided on a rear end portion of the push-pull rod 24 for enabling angle (pitch angle) of the blades of the propeller 23 with respect to advance direction of the boat 1 to be varied by means of the conversion mechanism 29. Thus, the propeller 23 is a variable pitch propeller whose pitch angle is made variable. The conversion mechanism 29 can be configured by, for example, forming protrusions to project radially from a circumferential surface of the rear end portion of the push-pull rod 24 and engaging the protrusions in grooves formed at base end portions of the blades of the propeller 23.

When the push-pull rod 24 advances, pitch angle increases, and when the push-pull rod 24 retracts, pitch angle decreases. By increasing-decreasing pitch angle, distance advanced by the boat 1 during one rotation of the blades of the propeller 23 can be varied from a positive range to a negative range. When pitch angle is positive, the outboard motor 10 generates propulsion in the forward direction of the boat 1, and when pitch angle is negative, generates propulsion in the reverse direction.

Figure 4:
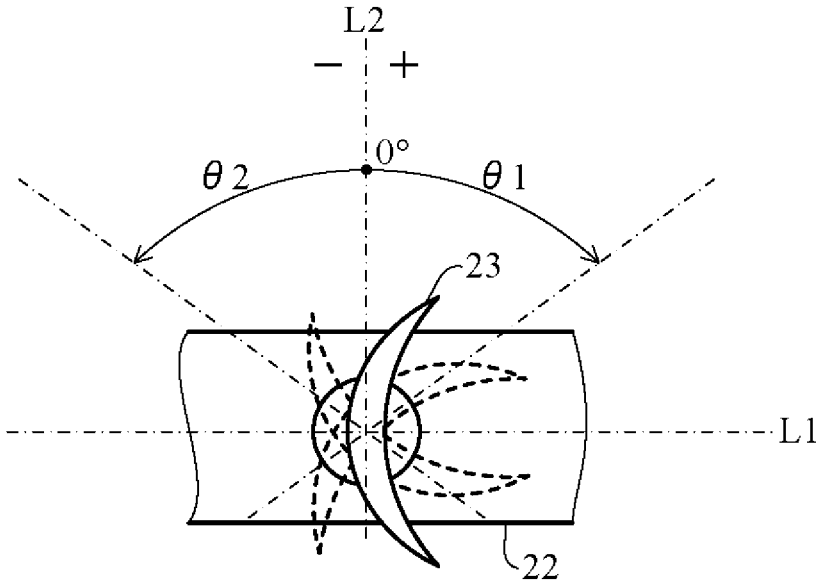
FIG. 4 is a side view of a single blade showing range of rotation of a propeller.

FIG. 4 is a side view of a single blade of the propeller 23 showing range of rotation of the blade of the propeller 23. In FIG. 4, axis L2 representing angle of the blade of the propeller 23 with respect to center axis L1 along the longitudinal direction of the propeller shaft 22 is shown in an orthogonal neutral state of pitch 0° (solid line), a state of the blade of the propeller 23 rotated from the neutral state toward the positive side to maximum pitch angle θ1 (+30°, for example; broken line), and a state rotated toward the negative side to maximum pitch angle θ2 (−30°, for example; broken line). When the blades of the propeller 23 are in neutral state, propulsion is 0. When pitch angle becomes maximum pitch angle θ1, forward propulsion per rotation of the blade becomes maximum, and when the pitch angle becomes maximum pitch angle θ2, reverse propulsion per rotation of the blade becomes maximum.

Figure 5:
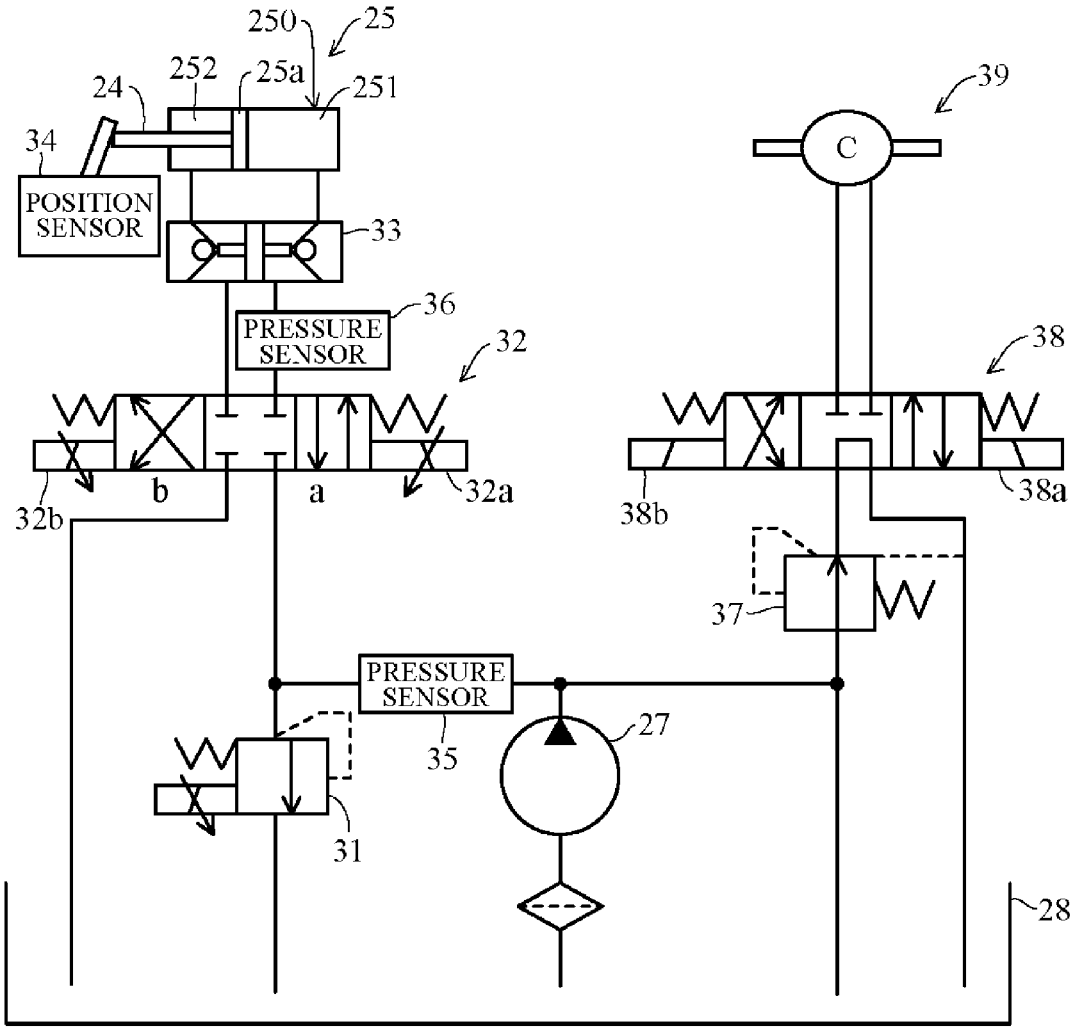
FIG. 5 is a hydraulic circuit diagram explaining a propeller pitch angle varying mechanism.

FIG. 5 is a hydraulic circuit diagram explaining a propeller pitch angle varying mechanism. The hydraulic pump 27 is driven by power from the engine 15. Hydraulic pressure discharged from the hydraulic pump 27 is regulated by a relief valve 31 and led to the direction switching valve (electromagnetic switching valve) 32. When a control signal is outputted to a solenoid 32*a*, the direction switching valve 32 switches from neutral position to position a. Thereby, hydraulic pressure from the hydraulic pump 27 is supplied through a pilot check valve 33 to an oil chamber 251 of the hydraulic cylinder 25 and the hydraulic cylinder 25 extends. As a result, the push-pull rod 24 retracts and pitch angle of the blades of the propeller 23 decreases.

On the other hand, when a control signal is outputted to a solenoid 32*b*, the direction switching valve 32 switches from neutral position to position b. Thereby, hydraulic pressure from the hydraulic pump 27 is supplied through the pilot check valve 33 to an oil chamber 252 of the hydraulic cylinder 25 and the hydraulic cylinder 25 contracts. As a result, the push-pull rod 24 advances and pitch angle of the blades of the propeller 23 increases.

Pitch angle is detected by a position sensor 34 that outputs a signal proportional to amount of movement of the cylinder rod (push-pull rod 24). When pitch angle reaches a desired pitch angle owing to switching of the direction switching valve 32 to position a or position b output of the control signal to the solenoid 32*a*/solenoid 32*b* is terminated. Accordingly, the direction switching valve 32 switches to neutral position and supply of hydraulic pressure to the hydraulic cylinder 25 stops. Hydraulic pressure (line pressure) between the hydraulic pump 27 and direction switching valve 32 and hydraulic pressure (cylinder pressure) between the direction switching valve 32 and hydraulic cylinder 25 are detected by hydraulic pressure sensors 35 and 36, respectively.

Pressure oil discharged from the hydraulic pump 27 is also supplied through a pressure reducing valve 37 and a direction switching valve 38 to a hydraulic cylinder 39. The hydraulic cylinder 39 is a hydraulic cylinder for clutch switching. The direction switching valve (electromagnetic switching valve) 38 is switched in response to control signals outputted to solenoids 38*a* and 38*b*. Switching of the direction switching valve 38 controls flow of pressure oil to the hydraulic cylinder 39 so as to engage and disengage the clutch of the shift mechanism 14.

Figure 6:
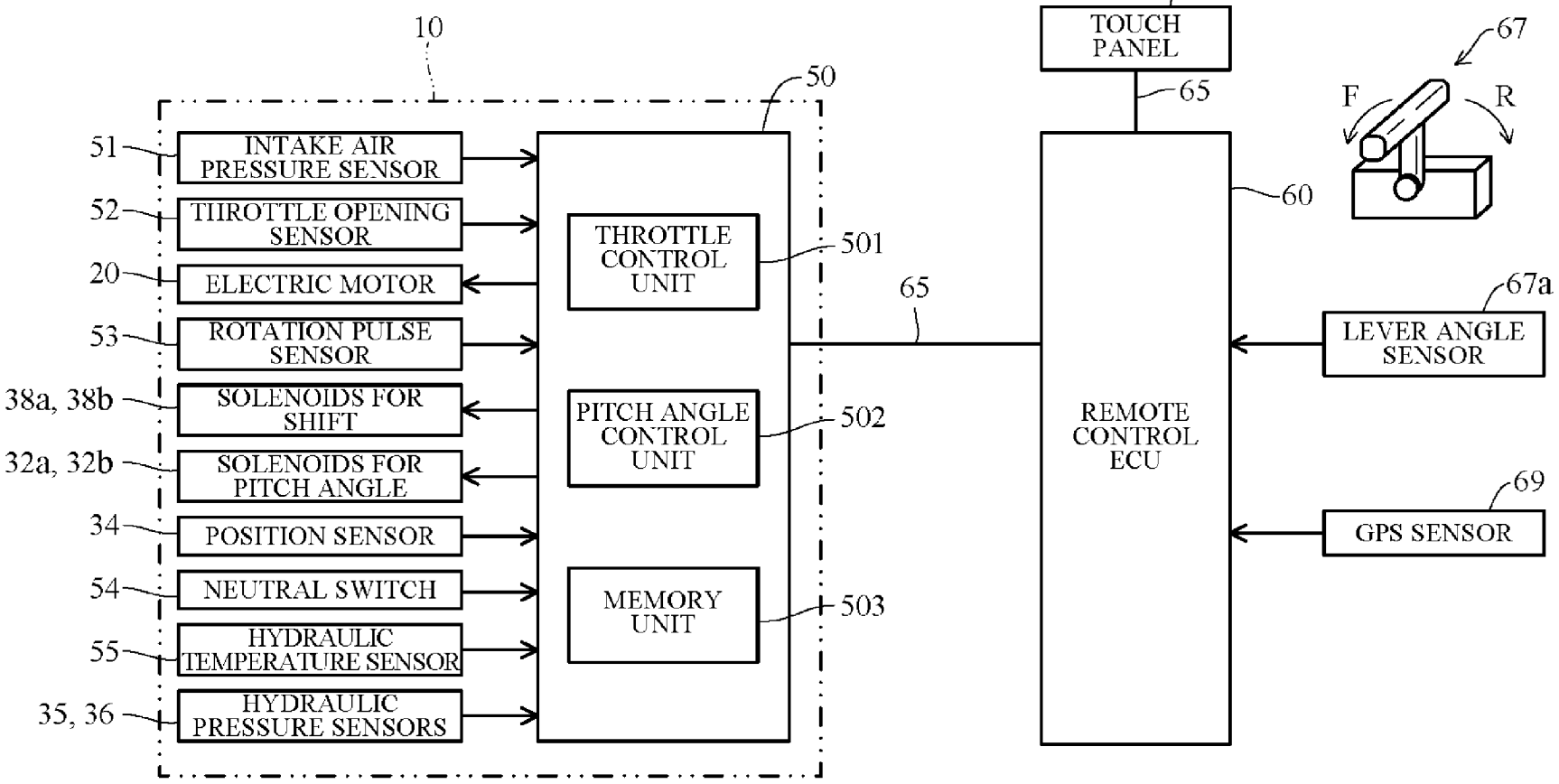
FIG. 6 is a block diagram showing a configuration of the outboard motor control apparatus according to the first embodiment.

FIG. 6 is a block diagram showing a configuration of the outboard motor control apparatus according to the first embodiment of the present invention. As shown in FIG. 6, the outboard motor 10 is equipped with an electronic control unit (hereinafter called ECU) 50. The ECU 50 is intercommunicably connected through a digital communication line 65 to another electronic control unit (hereinafter called remote control ECU) 60 mounted near a cockpit in the boat 1. The ECU 50 and remote control ECU 60 are both microcomputers configured by including arithmetic processing units comprising CPU, ROM, RAM and other peripheral circuits.

A touch panel 66 is connected to the remote control ECU 60 through the digital communication line 65. As shown in FIG. 1, the touch panel 66 is installed in the cockpit, and the boat operator can use the touch panel 66 to input various instructions to the remote control ECU 60. A throttle lever 67 and a steering wheel 68 operable by the boat operator are additionally provided in the cockpit. The throttle lever 67 can be rocked forward (arrow F direction) and rearward (arrow R direction) from the neutral position.

Figure 7:
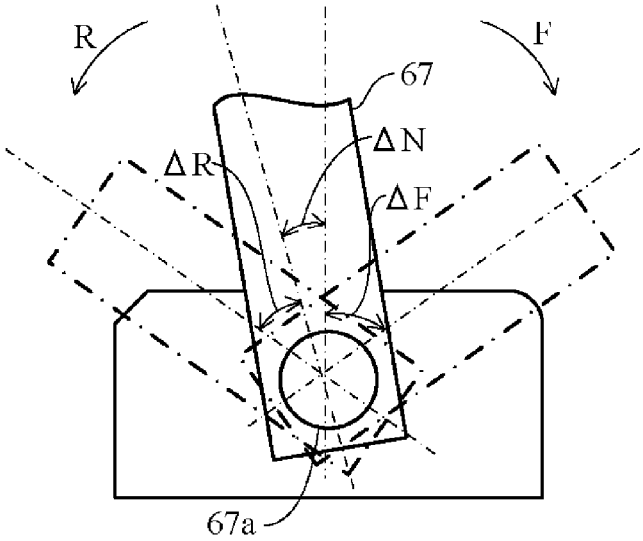
FIG. 7 is a diagram showing operation range of a throttle lever of FIG. 1.

FIG. 7 is a diagram showing operation range of the throttle lever 67. As shown in FIG. 7, the operation range of the throttle lever 67 is divided by an interposed middle neutral range ΔN into a forward range μF for instructing forward navigation of the boat 1 and a reverse range ΔR for instructing reverse navigation. Rocking the throttle lever 67 forward and rearward instructs forward and reverse navigation of the boat 1, and concomitantly inputs engine speed commands including acceleration and deceleration commands with respect to the engine 15. Operation of the throttle lever 67 is detected by a lever angle sensor 67*a* that outputs a signal proportional to amount S of lever operation.

As shown in FIG. 6, navigation speed of the boat 1 is detected by a GPS sensor 69. Signals from the touch panel 66, lever angle sensor 67*a* and GPS sensor 69 are inputted to the remote control ECU 60, and these signals are transmitted from the remote control ECU 60 to the ECU 50 through the digital communication line 65.

In addition to the signals transmitted from the remote control ECU 60, the ECU 50 also receives signals inputted from various sensors installed in the outboard motor 10. Specifically, it receives signals from an intake air pressure sensor 51 that detects pressure of air P taken into the engine 15 (intake air pressure), a throttle opening sensor 52 that detects opening angle T of the throttle valve 19, a rotation pulse sensor 53 that detects rotational speed N of the engine 15, the position sensor 34 that detects pitch angle θ of the blades of the propeller 23 of the propeller shaft 22, a neutral switch 54 that detects whether the shift position is neutral position, a hydraulic temperature sensor 55 that detects temperature of pressure oil supplied to the hydraulic cylinder 25, and the hydraulic pressure sensors 35 and 36.

As functional constituents, the ECU 50 has a throttle control unit 501, a pitch angle control unit 502, and a memory unit 503. The throttle control unit 501 controls throttle opening angle T by outputting a control signal to the throttle electric motor 20. The pitch angle control unit 502 controls pitch angle θ by outputting control signals to the solenoids 32*a* and 32*b* for pitch angle adjustment (FIG. 5) and switches shift position by outputting control signals to the solenoids 38*a* and 38*b* for shift switching (FIG. 4). The memory unit 503 stores in advance desired pitch angles θa corresponding to navigation speeds V of the boat 1.

Figure 8:
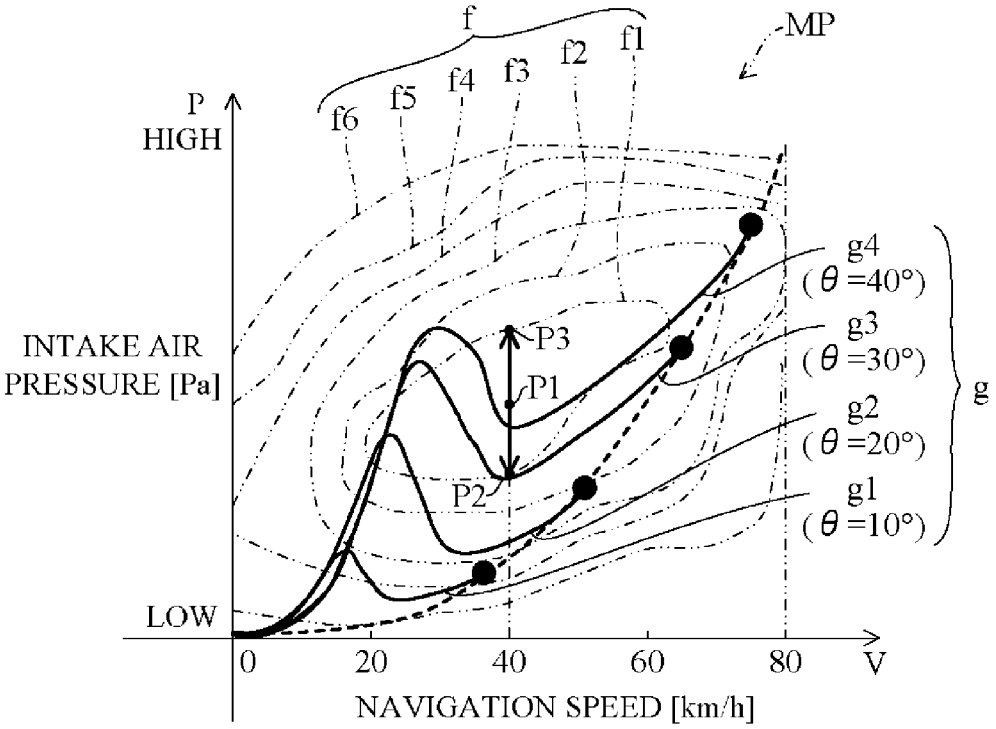
FIG. 8 is a diagram explaining the concept of a desired propeller pitch angle.

FIG. 8 is a diagram explaining the concept of the desired pitch angle θa. FIG. 8 shows a fuel consumption map MP drawn with navigation speed V (unit: km/h) plotted on horizontal axis and intake air pressure P (unit: Pa) plotted on vertical axis. The fuel consumption map MP is one that represents characteristics of fuel consumption quantity per unit time using contour lines (fuel consumption rate curves f (f1, f2, . . . )), in which a more inward fuel consumption rate curve represents lower fuel consumption and fuel consumption inside the fuel consumption rate curve f1 is lowest.

Intake air pressure P (intake air quantity) is correlated to load acting on the engine 15; namely, intake air pressure P increases as load increases. At any given navigation speed V (e.g., V=40 km/h or 60 km/h), fuel consumption is low at loads from medium level to high level, and fuel consumption efficiency is high in this zone. But when load is excessive, fuel consumption is great and fuel consumption efficiency declines.

Also shown on the characteristics of fuel consumption map MP of FIG. 8 are multiple running performance curves g (g1, g2, g3, g4) corresponding to different pitch angles θ. The running performance curves g represents loads on the engine 15 and are obtained from relationships between navigation speed V detected by the GPS sensor 69 and intake air pressure P detected by the intake air pressure sensor 51. The characteristics g1, g2, g3 and g4 of FIG. 8 are running performance curves at pitch angles θ of 10°, 20°, 30° and 40°. The upper limits (black bullets) of navigation speed V of the characteristics g1 to g4 represent maximum navigation speeds of the boat 1 at the respective pitch angles θ.

As shown in FIG. 8, in all of the characteristics g1 to g4, load once peaks prior to planing (state of speeding boat gliding on top of water). Comparing the characteristics g1 to g4, load (intake air pressure P) is seen to be higher and maximum navigation speed of the boat 1 faster in proportion as pitch angle θ is greater. In other words, propulsion is obtained at small pitch angle θ but maximum of navigation speed V is slow because distance advanced by the boat 1 during one rotation of the blades of the propeller 23 is small.

According to FIG. 8, when the navigation speed V of the boat 1 is 20 km/h, for example, the fuel consumption efficiency of characteristic g2 is high. On the other hand, when the navigation speed V is 40 km/h, for example, the fuel consumption efficiency of characteristic of g3 is higher than that of characteristic g2. This means that for every navigation speed V there exists a pitch angle θ whose fuel consumption efficiency is high (fuel performance is good). Taking this point into consideration, the present embodiment is configured to memorize in advance as desired pitch angle θa, the pitch angle θ whose fuel consumption corresponding to the navigation speed V is smallest, and control the pitch angle θ to the desired pitch angle θa corresponding to the detected navigation speed V.

As seen in FIG. 8, fuel consumption at a given navigation speed V (e.g., 40 km/h) is, strictly speaking, minimum at point P1 inside curve f1. But in the present embodiment, fuel consumption is assumed to be minimum, not at the minimum in the strictest sense, but in a range inside curve f1 where fuel consumption is equal to or less than a predetermined value, namely in the range of point P2 to point P3. At this time, the smallest pitch angle θ among the pitch angles θ meeting this definition of minimum (point P2 and P3; namely, point P2) is defined as desired pitch angle θa.

Figure 9:
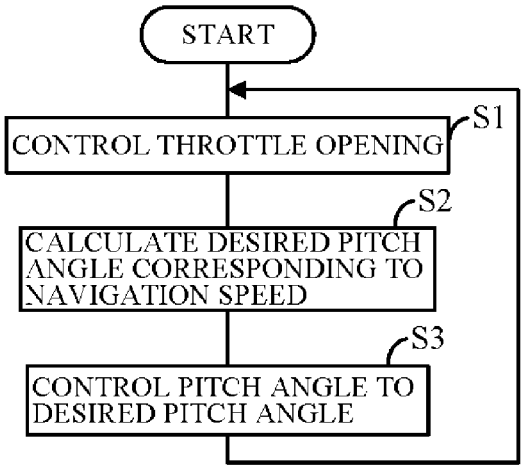
FIG. 9 is a flowchart showing operation of the outboard motor control apparatus according to the first embodiment.

FIG. 9 is a flowchart showing operation of the outboard motor control apparatus according to the first embodiment performed by the ECU 50. The processing shown in this flowchart is commenced, for example, when the throttle lever 67 is moved from neutral position to forward position.

First, in S1 (S: processing Step), processing is performed in the throttle control unit 501 by which a control signal commensurate with operation amount of the throttle lever 67 is outputted to the electric motor 20, thereby controlling throttle opening T. Specifically, detection value of the lever angle sensor 67*a* is acquired through the remote control ECU 60 and digital communication line 65 and a desired throttle opening commensurate with operation amount of the throttle lever 67 is calculated in accordance with a predetermined characteristic, thereby controlling throttle opening T to the desired throttle opening Ta.

Next, in S2, processing is performed in the pitch angle control unit 502 by which current navigation speed V detected by the GPS sensor 69 is acquired through the remote control ECU 60 and digital communication line 65. In addition, relation between navigation speeds V stored in the memory unit 503 in advance and desired pitch angle θa is used to calculate a desired pitch angle θa corresponding to current navigation speed V.

Next, in S3, processing is performed in the pitch angle control unit 502 by which control signals are outputted to the solenoids 32*a* and 32*b* for pitch angle adjustment, thereby controlling pitch angle θ to the desired pitch angle θa. More exactly, the signal from the position sensor 34 is used to feedback control pitch angle θ to the desired pitch angle θa. The ECU 50 repeatedly executes the processing of S1 to S3.

In this case, rather than controlling pitch angle θ to the desired pitch angle θa from the start, it is alternatively possible to first control pitch angle θ to an initial pitch angle θ0 and thereafter control it to the desired pitch angle θa commensurate with navigation speed V. For example, in an initial state immediately after forward rocking of throttle lever 67 is started, it is possible for the pitch angle control unit 502 to perform processing by which pitch angle θ is controlled in accordance with a predetermined characteristic to an initial pitch angle θ0 commensurate with operation amount of the throttle lever 67 and thereafter control it to the desired pitch angle θa commensurate with navigation speed V. Otherwise, it is possible to control pitch angle θ to a predetermined somewhat small initial pitch angle θ0 in the initial state and thereafter control it to the desired pitch angle θa commensurate with navigation speed V. In other words, it is possible first to control pitch angle θ to an initial pitch angle θ0 either before calculating or after calculating the desired pitch angle θa in S2.

Switching of pitch angle θ from initial pitch angle θ0 to desired pitch angle θa can be done when navigation speed V becomes equal to or greater than a predetermined navigation speed (e.g., planing state) or upon elapse of a predetermined time after rocking operation of the throttle lever 67 is started. It is also possible to install an automatic mode switch for implementing a pitch angle θ automatic change mode that changes pitch angle θ from initial pitch angle θ0 to the desired pitch angle θa when the automatic mode switch is operated by the boat operator.

Figure 10:
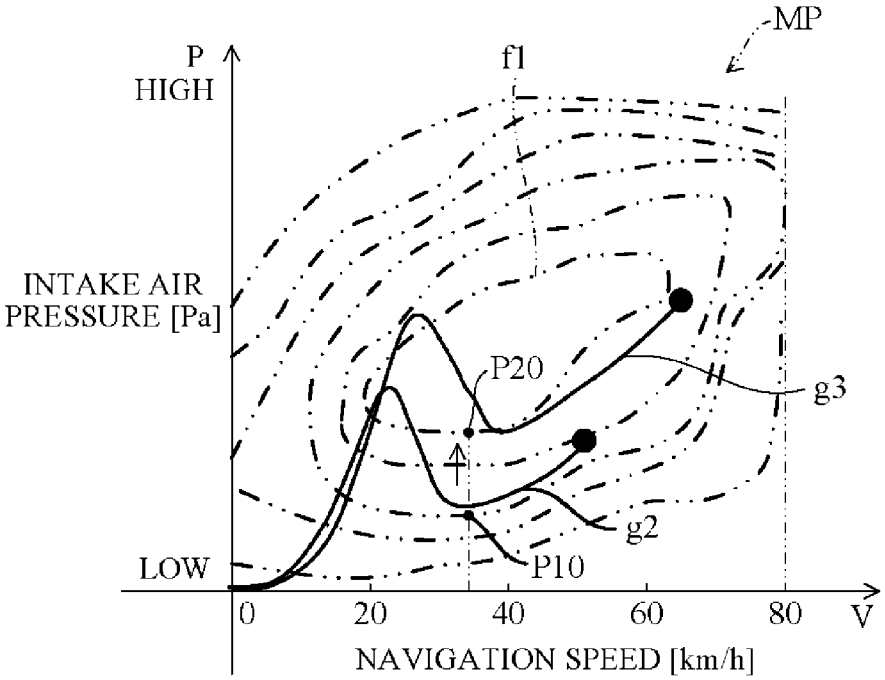
FIG. 10 is a diagram explaining an example of control by the outboard motor control apparatus according to the first embodiment.

FIG. 10 is a diagram explaining an example of control by the outboard motor control apparatus according to the first embodiment of the present invention. In FIG. 10, the boat 1 is assumed to be navigating at navigation speed of 40 km/h with the pitch angle θ of the propeller 23 of the outboard motor 10 in a state controlled to an initial pitch angle θ0 represented by characteristic g2 of the running performance curves (20° in this example; point 10). At this time, the pitch angle control unit 502 calculates a desired pitch angle θa corresponding to or commensurate with the navigation speed V (in this example, desired pitch angle θa=30° represented by characteristic g3 of the running performance curves) (S2) and controls pitch angle θ to this desired pitch angle θa (S3).

When pitch angle θ increases to the desired pitch angle θa, load acting on the engine 15 (intake air pressure P) increases and engine speed decreases with increasing load. Therefore, distance navigated by the boat 1 per rotation of the propeller 23 increases, but rotational speed of the propeller 23 decreases so that navigation speed V hardly changes between before and after change of pitch angle θ to the desired pitch angle θa. Relationship between navigation speed V and intake air pressure P therefore changes from point P10 to point P20 of FIG. 9 and fuel efficiency can be improved while maintaining navigation speed V constant.

As stated above, the first embodiment is configured to have an apparatus for controlling an outboard motor (10) mounted on a hull (1*a*) of a boat (1) and having an internal combustion engine (15), a throttle lever (67) configured to be operable by an operator to regulate a throttle opening T of a throttle valve (19) of the engine, and a propeller (23)

powered by the engine, the propeller being a variable pitch propeller whose pitch angle is made variable, comprising: a navigation speed detector (GPS sensor 69) configured to detect a navigation speed V of the boat; a throttle control unit (501) configured to control the throttle opening T of the engine based on an operation amount S of the throttle lever 67; a memory unit (503) configured to memorize characteristics defining a desired pitch angle θa of the propeller that makes fuel consumption minimum relative to the navigation speed V of the boat; and a pitch angle control unit (502) configured to control the pitch angle θ of the propeller to the desired pitch angle θa that is corresponding to the navigation speed V detected by the navigation speed detector.

Thus, in the first embodiment, the inventors focused on the fact that the desired pitch angles θa of the propeller 23 that make fuel consumption minimum exists relative to the respective navigation speeds V of the boat 1 and configures the apparatus to memorize the characteristics therebetween and to control the pitch angle θ to the desired pitch angle θa that is corresponding to the detected navigation speed V. With this, it becomes possible to improve fuel consumption efficiency by a simple configuration. Since the change of the pitch angle θ causes the load P and engine speed N to change, the navigation speeds V before and after the change of pitch angle θ becomes close to each other, thereby enabling to enhance steerability of the boat 1.

In the apparatus, the pitch angle controlling unit (502) may control the pitch angle θ of the propeller 23 to an initial pitch angle θ0 or predetermined initial pitch angle θ0 based on the operation amount S of the throttle lever 67, and controls the pitch angle θ of the propeller to the desired pitch angle θa in accordance with the characteristics defining the desired pitch angle θa relative to the navigation speed V of the boat 1 memorized in the memory unit 503. The change may be based on a condition that navigation speed V becomes the predetermined speed at which difference of the fuel consumption becomes large. Specifically, the pitch angle controlling unit (502) controls the pitch angle of the propeller 23 to a constant pitch angle when the navigation speed V detected by the navigation speed detector (GPS sensor) 69 is smaller than a predetermined navigation speed (e.g., 20 km/h), and controls the pitch angle θ of the propeller 23 to the desired pitch angle θs when the navigation speed V detected by the navigation speed detector is equal to or greater than the predetermined speed. With this, it becomes further improve the fuel consumption.

In the apparatus, the pitch angle controlling unit (502) determines, if the fuel consumption is assumed to be minimum when the pitch angle θ is equal to or greater than a first pitch angle (corresponding to point P2 in FIG. 8) and is equal to or smaller than a second pitch angle (corresponding to point P3 in FIG. 8), the first pitch angle as the desired pitch angle θa, and controls the pitch angle of the propeller to the first pitch angle. With this, at the time of changing the pitch angle θ to the desired pitch angle θa (for example, at the time of changing from point P10 to point P20 in FIG. 10), it becomes possible to make the change amount small, thereby enabling to improve fuel consumption while minimizing engine load increase.

Second Embodiment

A second embodiment of the present invention will be explained with reference to FIGS. 11 to 14. In the following, points of difference from the first embodiment are mainly explained.

The second embodiment differs from the first embodiment chiefly in the processing in the ECU 50. In the first embodiment, relationship between navigation speed V and desired pitch angle θa that minimizes fuel consumption is determined in advance and pitch angle θ is controlled to the desired pitch angle θa based on navigation speed V. In contrast, in the second embodiment, desired throttle opening Ta and desired pitch angle θa are defined in advance as functions of amount of operation S of the throttle lever 67 in each of multiple modes, and throttle opening T and pitch angle θ are controlled accordingly to the desired throttle opening Ta and the desired pitch angle θa.

Figure 11:
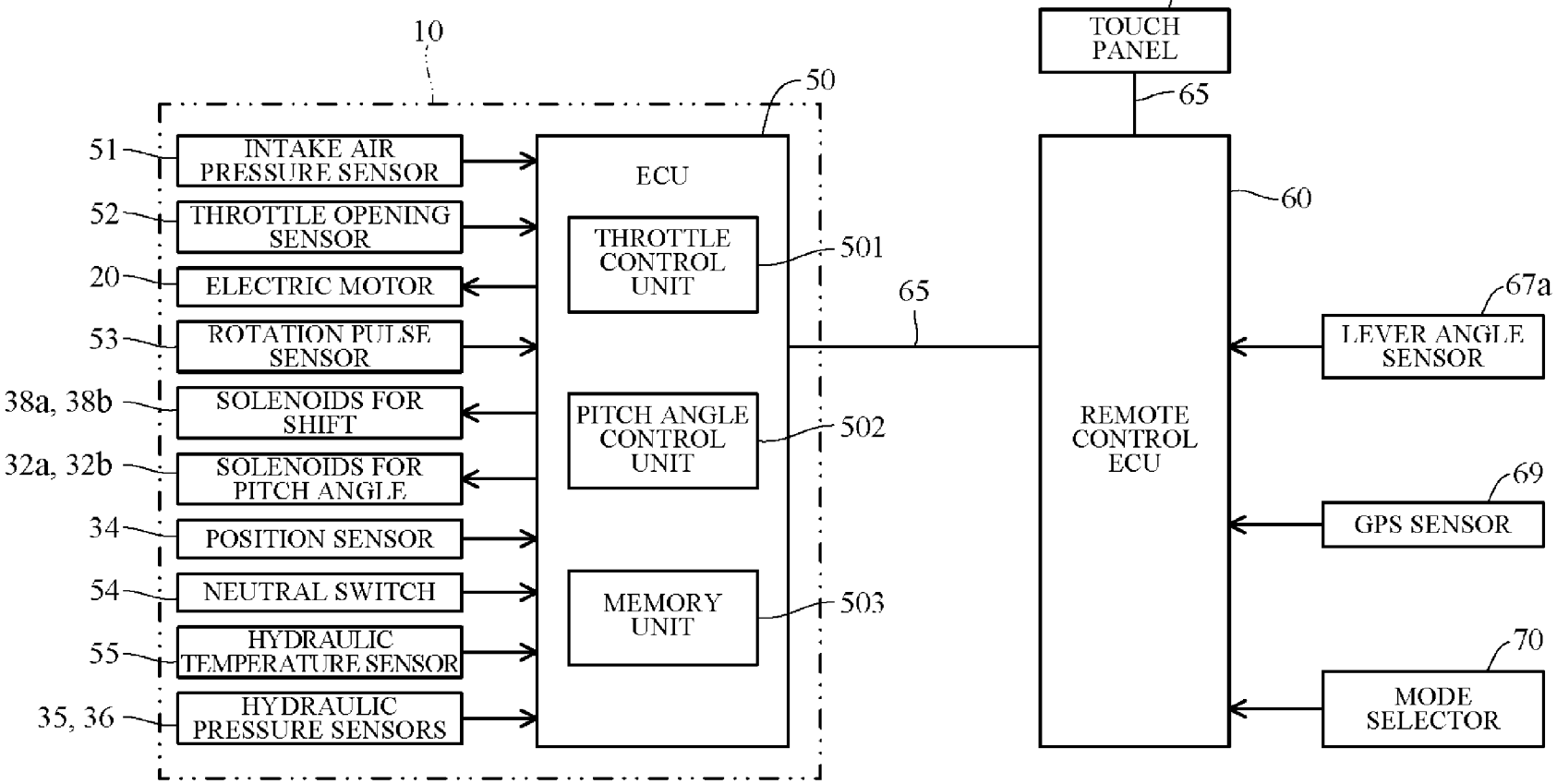
FIG. 11 is a diagram, similar to FIG. 6, but showing a configuration of the outboard motor control apparatus according to the second embodiment of the present invention.

FIG. 11 is a block diagram showing a configuration of the outboard motor control apparatus according to the second embodiment of the present invention. Portions like those in FIG. 6 are assigned the same symbols as those in FIG. 6. As shown in FIG. 11, a mode selector 70 is additionally connected to the remote control ECU 60. The mode selector 70 comprises a dial manipulated by the operator to select one among multiple operating modes (acceleration mode A, acceleration mode B and acceleration mode C).

Figure 12:
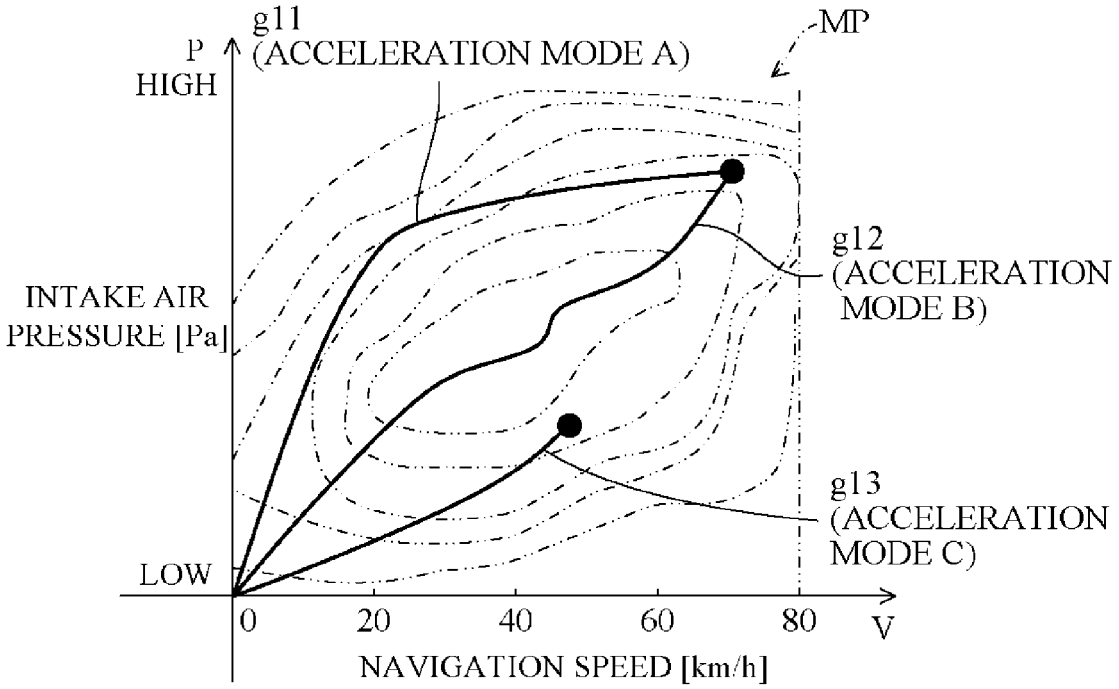
FIG. 12 is a diagram showing characteristics of different modes on a fuel consumption map used in the outboard motor control apparatus according to the second embodiment.

FIG. 12 is a diagram showing characteristics of the different modes on a fuel consumption map MP. Characteristics g11, g12 and g13 correspond to acceleration mode A, acceleration mode B and acceleration mode C, respectively.

Acceleration mode B is a mode that is given priority to fuel efficiency (fuel efficiency priority mode). Characteristic g12 is therefore a characteristic that traces along points of low fuel consumption on the fuel consumption map MP.

Acceleration mode A is a mode that is given higher priority to time economy (navigation speed V) than fuel efficiency (navigation speed priority mode). Acceleration mode A is selected in cases of high necessity to obtain adequate navigation speed, such when the boat 1 is heavily loaded and load on the engine 15 is great. Therefore, characteristic g11 is a characteristic of higher load than characteristic g12 of acceleration mode B.

In the case of a boat used by someone engaged in fishery or someone engaged in marine transport, for example, the amount of cargo (load) carried on the boat 1 differs between the outward voyage to the destination and the homeward voyage from the destination. Specifically, the amount of cargo loaded on the boat 1 may be small going out and great coming home. The boat operator therefore selects acceleration mode B on the outbound voyage. On the other hand, cargo is heavy on the homebound voyage because the fisherman loads the boat 1 with fish or the shipper loads it with loose sand or the like, for example. In such a case, the boat operator selects acceleration mode A on the homeward voyage because a quick return from the destination is desired.

Acceleration mode C is a mode that is given priority to boat steerability in the course of steering of the boat 1 during casting off and docking (boat steerability priority mode). At the time of casting off or docking, fast navigation speed is not needed and what is required is fine speed adjustment by operation (manipulation) of the throttle lever 67 that facilitates steering of the boat 1. So compared to characteristic g12 of acceleration mode B, characteristic g13 of acceleration mode C is a lighter load and lower speed characteristic by which speed change of the boat 1 relative to operation amount S of the throttle lever 67 is small.

The aforesaid acceleration modes A to C can be implemented by controlling throttle opening T and pitch angle θ to a desired throttle opening Ta and a desired pitch angle θa, which differ among the individual modes, based on amount of operation of the throttle lever 67.

Figure 13:
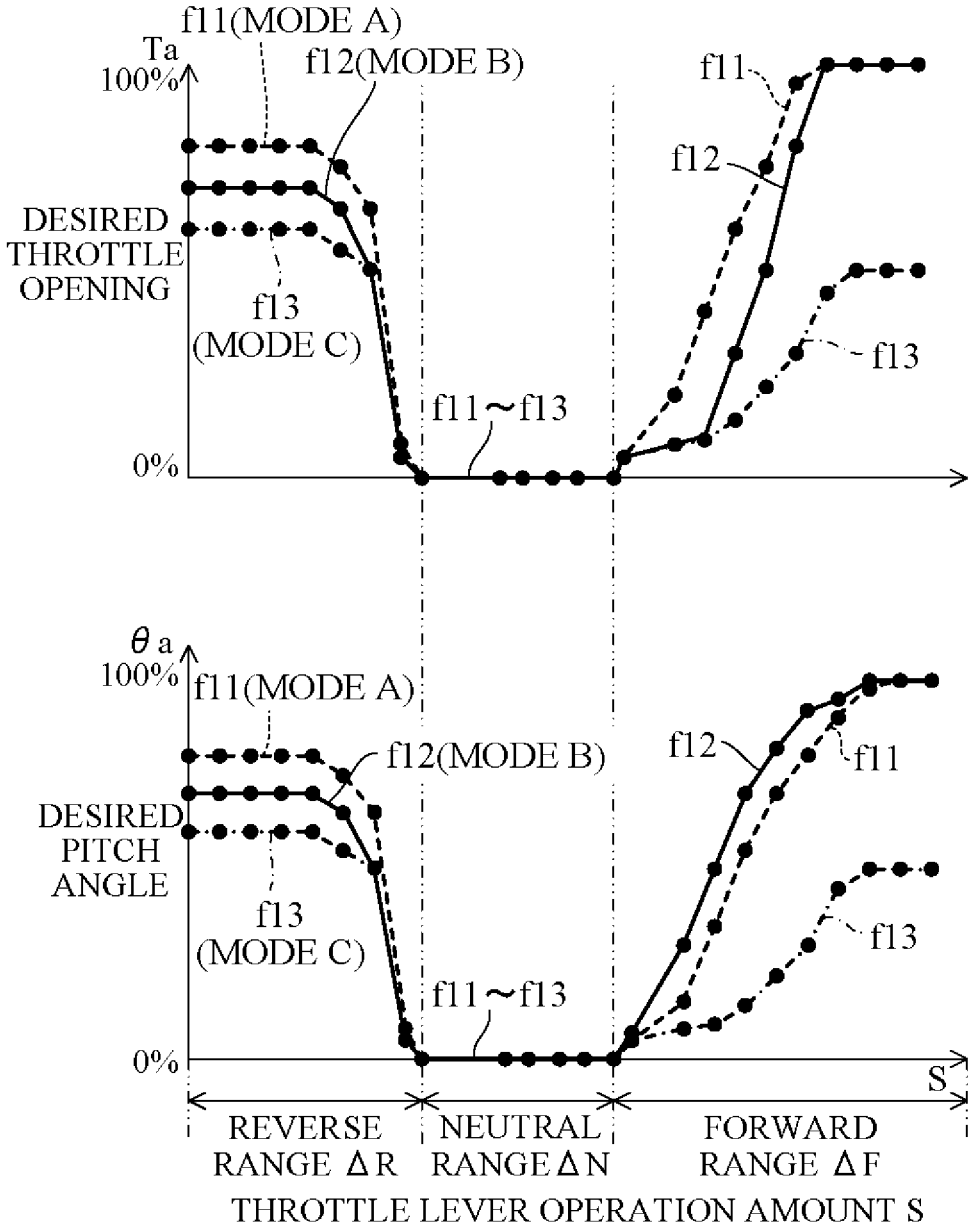
FIG. 13 is a set of diagrams showing relationships between desired throttle opening and desired pitch angle relative to operation amount of detected throttle lever.

FIG. 13 is a set of diagrams showing relationships between desired throttle opening Ta and desired pitch angle θa relative to operation amount S of the throttle lever 67 detected by the lever angle sensor 67*a*. In the diagram, f11 (dotted line) corresponds to acceleration mode A, f12 (solid line) to acceleration mode B, and f13 (one-dot-dashed line) to acceleration mode C. The vertical axes in FIG. 12 respectively represent ratio (%) relative to maximum value of desired throttle opening Ta and relative to maximum value of desired pitch angle θa, between minimum of 0 and maximum of 100. Although desired pitch angle θa is negative in reverse range ΔR, it is for convenience inverted in sign and indicated as a positive value in FIG. 13.

As shown in FIG. 13, in all acceleration modes A to C, desired throttle opening Ta and desired pitch angle θa increase in reverse range ΔR with increasing amount of operation S of the throttle lever 67 out of neutral range ΔN. At this time, desired throttle opening Ta and desired pitch angle θa increase at faster rate in order of acceleration mode C, B, A. In neutral range ΔN, desired throttle opening Ta and desired pitch angle θa are both 0 in all acceleration modes A to C.

In all acceleration modes A to C, desired throttle opening Ta and desired pitch angle θa increase in forward range ΔF with increasing amount of operation S of the throttle lever 67 out of neutral range ΔN. At this time, rate of increase of desired throttle opening Ta is greater in order of acceleration mode C, B, A. In acceleration mode A, desired throttle opening Ta rises particularly early, so the engine 15 can generate high power in response to high load.

On the other hand, rate of increase of desired pitch angle θa in forward range ΔF is greater in order of acceleration mode C, A, B. Comparing characteristic f11 of acceleration mode A and characteristic f12 of acceleration mode B, characteristic f12 is greater as regards desired pitch angle θa, while characteristic f11 is greater as regards desired throttle opening Ta. This is because pitch angle θ is preferentially increased in acceleration mode B in order to improve fuel efficiency. Increase rate of desired throttle opening Ta and desired pitch angle θa is smaller in acceleration mode C than in the other two acceleration modes A and B because propulsion by manipulation of the throttle lever 67 is decreased in acceleration mode C. The aforesaid characteristics f11 to f13 are stored in the memory unit 503 of the ECU 50 in advance.

Figure 14:
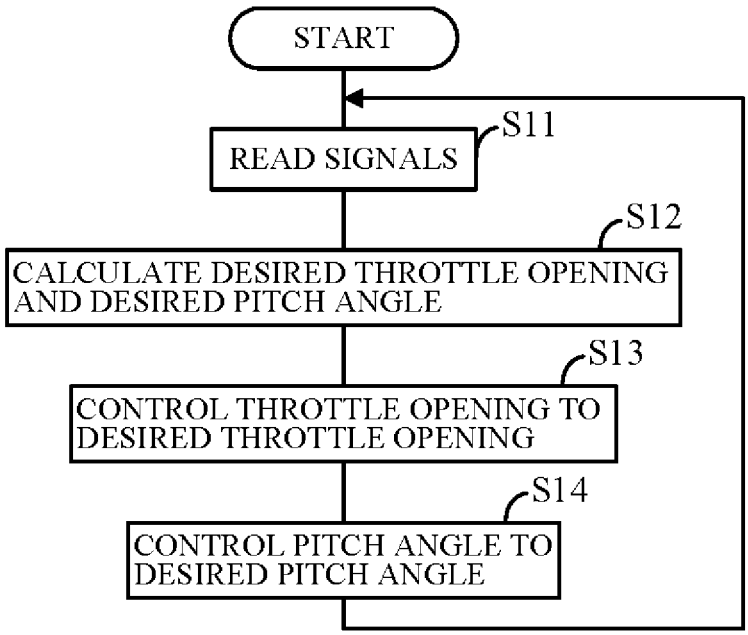
FIG. 14 is a flowchart, similar to FIG. 9, but showing operation of the outboard motor control apparatus according to the second embodiment.

FIG. 14 is a flowchart showing an example of processing performed by the ECU 50 of the outboard motor control apparatus according to the second embodiment of the present invention. The processing shown in this flowchart is commenced, for example, when an engine key switch is turned ON.

First, in S11, signals from the lever angle sensor 67*a* and the mode selector 70 are read (acquired) through the remote control ECU 60 and the digital communication line 65. By this, the ECU 50 determines the operation amount S of the throttle lever 67 and the mode selected by the boat operator.

Next, in S12, processing is performed in the throttle control unit 501 and pitch angle control unit 502 by which the characteristics f11 to f13 stored in the memory unit 503 in advance are used to calculate a desired throttle opening Ta and desired pitch angle θa corresponding to or commensurate with the selected mode and operation amount S of the throttle lever 67.

Next, in S13, processing is performed in the throttle control unit 501 by which a control signal commensurate with operation amount S of the throttle lever 67 is outputted to the electric motor 20, thereby controlling throttle opening T to the desired throttle opening Ta. Then, in S14, processing is performed in the pitch angle control unit 502 by which control signals are outputted to the solenoids 32*a* and 32*b* for pitch angle adjustment, thereby controlling pitch angle θ to the desired pitch angle θa. The ECU 50 repeatedly executes the processing of S11 to S14.

As stated above, the second embodiment is configured to have an apparatus for controlling an outboard motor (10) mounted on a hull (1*a*) of a boat (1) and having an internal combustion engine (15), a throttle lever (67) configured to be manipulated by an operator to regulate a throttle opening of a throttle valve (19) of the engine, and a propeller (23) powered by the engine, the propeller being a variable pitch propeller whose pitch angle is made variable, comprising: a throttle lever operation amount detector (lever angle sensor 67*a*) configured to detect an operation amount S of the throttle lever; a memory unit (503) configured to memorize characteristics defining a desired throttle opening Ta of the engine and a desired pitch angle θa of the propeller 23 that make fuel consumption minimum relative to the operation amount S of the throttle lever; a throttle control unit (501) configured to control the throttle opening T of the engine to the desired throttle opening Ta based on the operation amount S of the throttle lever detected by the throttle lever operation amount detector in accordance with the characteristics memorized by the memory unit; and a pitch angle control unit (502) configured to control the pitch angle θ of the propeller 23 to the desired pitch angle θa based on the operation amount S of the throttle lever detected by the throttle lever operation amount detector in accordance with the characteristics memorized by the memory unit.

Thus, the second embodiment is configured to control the throttle opening T to the desired throttle opening Ta and the pitch angle θ to the desired pitch angle θa based on the throttle lever operation amount S in such a manner that, for example, a relationship between the navigation speed V and intake air pressure P changes in accordance with the characteristics g12 of FIG. 12 in the acceleration mode B. With this, it becomes possible to improve fuel consumption efficiency by a simple configuration.

The apparatus further includes: a mode selector (70) configured to be operable by the operator to select one among operation modes (acceleration modes A to C) including a fuel consumption priority mode (acceleration mode B) that is given priority to the fuel consumption, characteristics (f11 to f13) of the operation modes defining the desired throttle opening Ta of the engine and the desired pitch angle θa of the propeller 23 being memorized by the memory unit (503); and the throttle control unit (501) controls the throttle opening T of the engine to the desired throttle opening Ta based on the operation amount S of the throttle lever 67 in accordance with the characteristics of the one among the operation modes selected by the mode selector and memorized by the memory unit; and the pitch angle control unit (502) controls the pitch angle θ of the propeller 23 to the desired pitch angle θa based on the operation amount S of the throttle lever 23 in accordance with the characteristics of the one among the operation modes selected by the mode selector and memorized by the memory unit.

With this, even when the throttle lever operation amount S is the same, it becomes possible to control the throttle opening T and pitch angle θ to the desired values that are different among the modes, thereby enabling to navigate the boat 1 as desired by the operator.

In the apparatus, the operation modes include a navigation speed priority mode (acceleration mode A) that is given priority to the navigation speed of the boat 1 than the fuel consumption; the throttle control unit (501) makes the throttle opening T of the engine greater when the navigation speed priority mode is selected than that when the fuel consumption priority mode is selected; and the pitch angle control unit (502) controls the pitch angle θ of the propeller 23 to decrease when the navigation speed priority mode is selected than that when the fuel consumption priority mode is selected.

With this, by selecting the navigation speed priority mode when the amount of cargo carried on the boat 1 is heavy, for example, it becomes possible to obtain a sufficient navigation speed, enabling to improve economical efficiency in time.

In the apparatus, the operation modes include a boat steerability priority mode (acceleration mode C) that is given priority to steerability of the boat than the fuel consumption; the throttle control unit (501) decreases the throttle opening T of the engine when the boat steerability priority mode is selected than that when the fuel consumption priority mode is selected; and the pitch angle control unit (502) decreases the pitch angle θa of the propeller 23 when the boat steerability priority mode is selected than that when the fuel consumption priority mode is selected.

With this, by selecting the boat steerability priority mode during casting off and docking of the boat 1, for example, it becomes possible to perform fine speed adjustment by operating the throttle lever 67, enabling to improve steerability of the boat 1.

Third Embodiment

In the foregoing first and second embodiments, a case of configuring an outboard motor control apparatus was explained with focus chiefly on fuel efficiency performance of the outboard motor 10. But the outboard motor 10 also requires good acceleration performance of the boat 1 when rapid acceleration is instructed by operation (manipulation) of the throttle lever 67. In a third embodiment, therefore, the control apparatus for an outboard motor is configured to enhance acceleration performance. The third embodiment of the present invention is explained in the following with reference to FIGS. 15 to 20.

Figure 15:
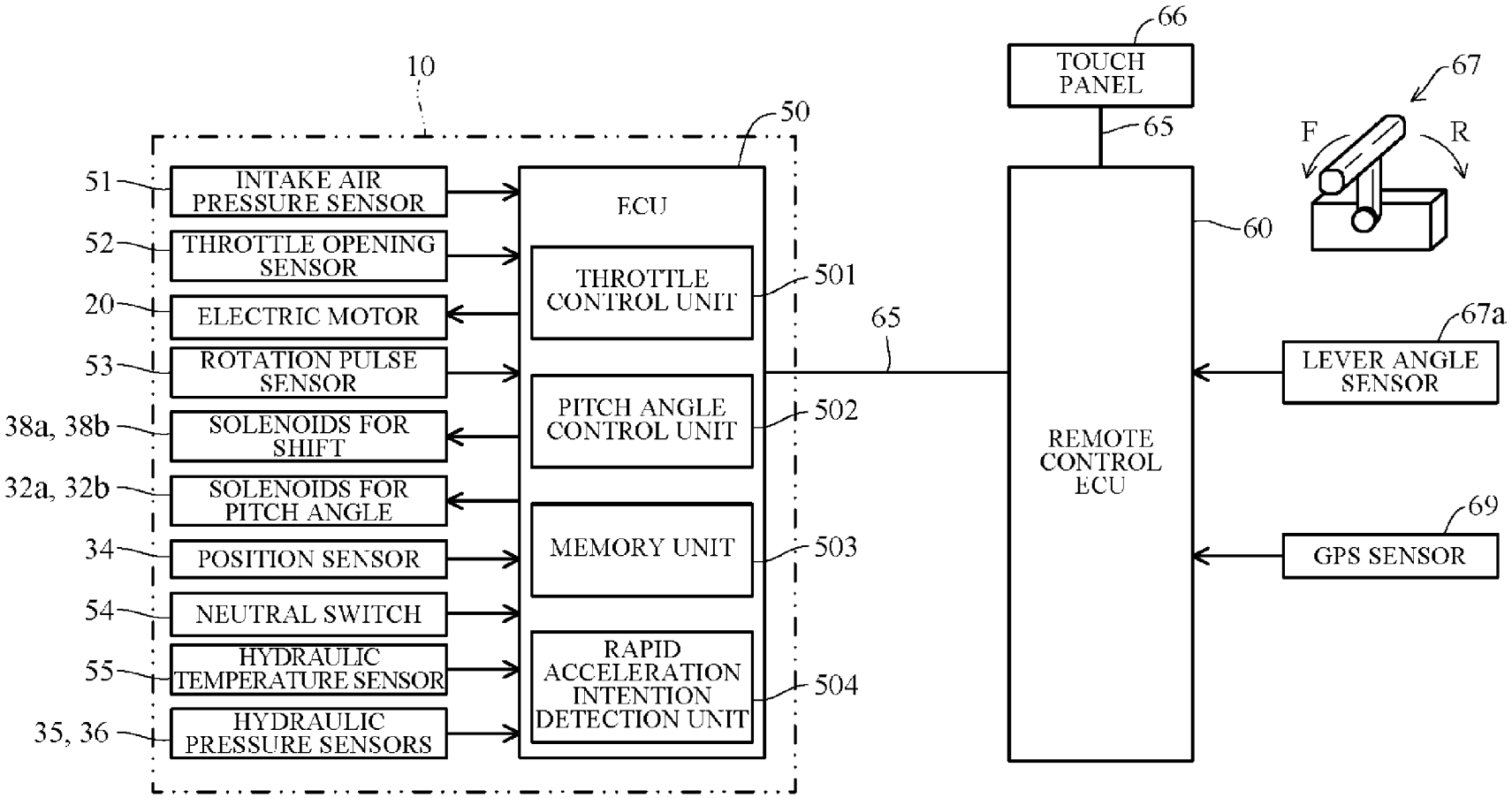
FIG. 15 is a diagram, similar to FIG. 6, but showing a configuration of the outboard motor control apparatus according to the third embodiment of the present invention.

FIG. 15 is a block diagram showing a configuration of the outboard motor control apparatus according to the third embodiment of the present invention. The control apparatus of FIG. 15 can be configured on the basis of the control apparatus of either the first embodiment (FIG. 6) or the second embodiment (FIG. 11). An example configured on the basis of the control apparatus of the second embodiment is explained in the following. In FIG. 15, portions like those in FIG. 11 are assigned the same symbols as those in FIG. 11.

As shown in FIG. 15, the ECU 50 has as functional constituents the throttle control unit 501, the pitch angle control unit 502, the memory unit 503, and a rapid acceleration intention detection unit 504. The rapid acceleration intention detection unit 504 detects rapid acceleration intention made by the operator through operation of the throttle lever 67. The mode selector 70 is omitted in FIG. 15, and operation mode is fixed in a predetermined mode (e.g., fuel efficiency priority mode).

Figure 16:
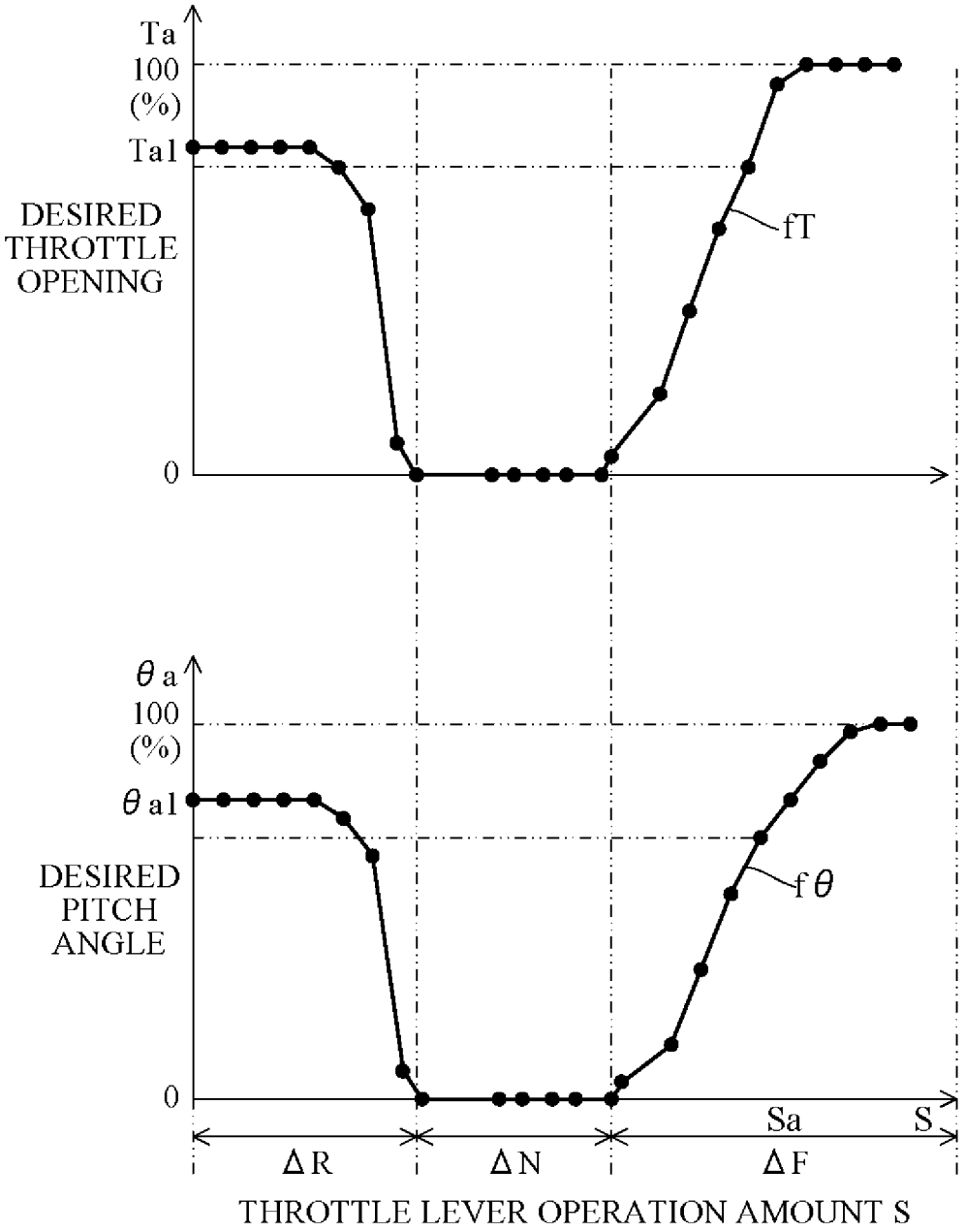
FIG. 16 is a set of diagrams, similar to FIG. 13, but showing relationships between desired throttle opening and desired pitch angle relative to operation amount of detected throttle lever.

FIG. 16 is a diagram showing how desired throttle opening Ta and desired pitch angle θa are related to operation amount S of the throttle lever 67 in the predetermined mode. In the diagram, desired throttle opening Ta and desired pitch angle θa are represented by characteristics fT and fθ. Characteristics fT and fθ correspond to, for example, characteristic f12 (fuel efficiency priority characteristic) of FIG. 13. The characteristics fT and fθ are stored in the memory unit 503 of the ECU 50 in advance.

The throttle control unit 501 controls throttle opening T in accordance with stored characteristic fT to a desired throttle opening Ta corresponding to or commensurate with lever operation amount S. The pitch angle control unit 502 controls pitch angle θ in accordance with stored characteristic fθ to a desired pitch angle θa corresponding to or commensurate with lever operation amount S.

Of note here is that should throttle opening T and pitch angle θ be controlled in accordance with the fuel efficiency priority characteristics IT and fθ when a forward-side rapid acceleration command comes from the throttle lever 67 at a time when navigation speed is too slow (e.g., when the boat 1 is not moving), load on the engine 15 becomes great. As a result, engine speed cannot be smoothly increased, so that acceleration performance is bad. Acceleration performance of the boat 1 is therefore improved by implementing acceleration control different from ordinary control when the rapid acceleration intention detection unit 504 detects a rapid acceleration intention of the operator.

Figure 17:
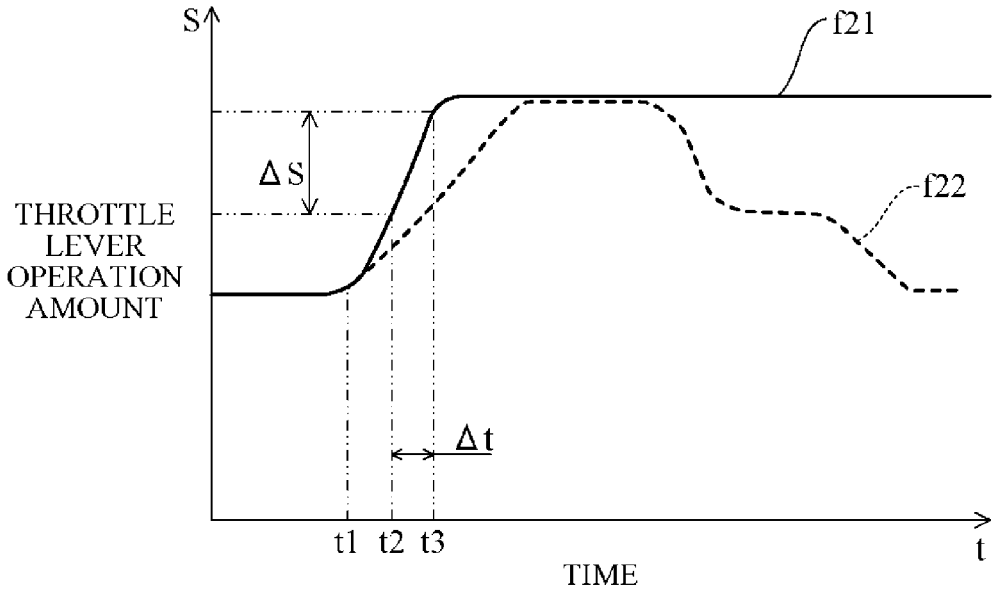
FIG. 17 shows an example of change in operation amount of the throttle lever over time.

The rapid acceleration intention detection unit 504 detects rapid acceleration intention as follows. FIG. 17 shows an example of change in operation amount S of the throttle lever 67 over time. In the diagram, f21 (solid line) is a characteristic at a time of a rapid acceleration command and f22 (dotted line) is a characteristic at a time of ordinary, not rapid, acceleration. As indicated in FIG. 17, starting from forward-side acceleration operation out of neutral position of the throttle lever 67 at time t1, lever operation amount S increase rate (slope of characteristic) is sharper for characteristic f21 at time of rapid acceleration command than for characteristic f22 at time of ordinary acceleration command.

With this in mind, detection of rapid acceleration intention is enabled in the third embodiment by in advance establishing a threshold (not shown) with respect to the operation amount S. And the rapid acceleration intention detection unit 504 discriminates whether rate of increase per unit time of the operation amount S detected by the lever angle sensor 67*a* (ΔS/Δt) exceeded the threshold and detects occurrence of a rapid acceleration intention when the rate exceeds the threshold (time t3). Upon rapid acceleration intention detection, the ECU 50 performs acceleration control.

Figure 18:
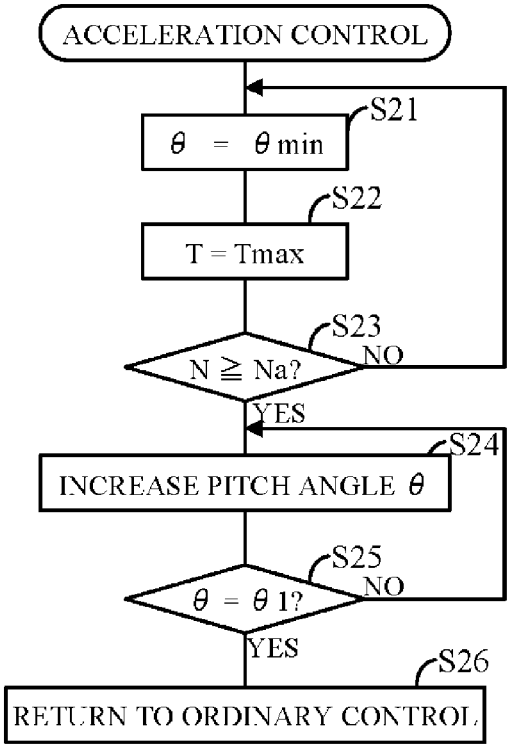
FIG. 18 is a flowchart, similar to FIG. 9, but showing operation of the outboard motor control apparatus according to the third embodiment.

FIG. 18 is a flowchart showing an example of processing performed by the ECU 50 during the acceleration control. The processing shown in this flowchart is commenced upon detection of a rapid acceleration intention by the rapid acceleration intention detection unit 504.

First, in S21, processing is performed in the pitch angle control unit 502 by which control signals are outputted to the solenoids 32*a* and 32*b* of the direction switching valve 32 for pitch angle adjustment to control pitch angle θ to minimum pitch angle θmin that minimizes load acting on the engine 15, namely to 0°. Then, in S22, processing is performed in the throttle control unit 501 by which a control signal is outputted to the electric motor 20 to control throttle opening T to maximum throttle opening Tmax (wide open).

Next, in S23, the output from the rotation pulse sensor 53 is read and it is discriminated whether current engine speed N is equal to or greater than a predefined desired engine speed Na. The desired engine speed Na is defined as a rotational speed at which engine output is of adequately high level, e.g., as maximum engine speed Nmax. When the result in S23 is NO, the program returns to S21, and when YES, goes to S24.

In S24, processing is performed in the pitch angle control unit 502 by which control signals are outputted to the solenoids 32*a* and 32*b* to gradually increase pitch angle θ. In other words, pitch angle θ is increased at a predetermined increase rate per unit time. Next, in S25, the output from the position sensor 34 is read and it is discriminated whether pitch angle reached maximum angle θ1. When the result in S25 is YES, the program goes to S26, and when NO, returns to S24.

In S26, acceleration control is terminated and ordinary control implemented. The throttle control unit 501 thereafter controls throttle opening T as a function of operation amount S of the throttle lever 67 in accordance with characteristic fT of FIG. 16. The pitch angle control unit 502 controls pitch angle θ as a function of operation amount S of the throttle lever 67 in accordance with characteristic fθ of FIG. 16.

Operation of the control apparatus for an outboard motor according to the third example will be explained in concrete detail.

Figure 19:
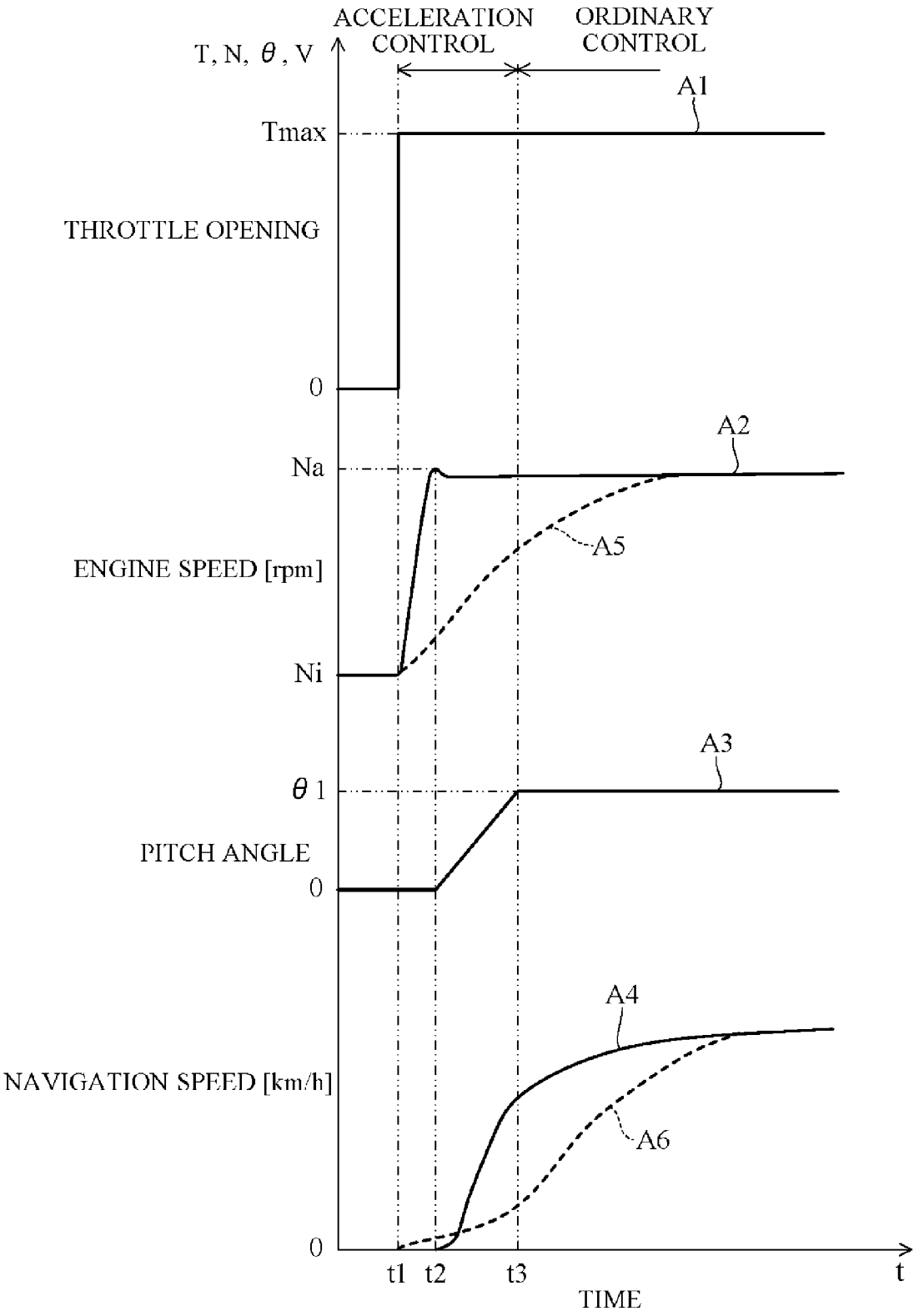
FIG. 19 is a time chart showing an example of time-course change of throttle opening, engine speed, pitch angle, and navigation speed.

FIG. 19 is a time chart showing an example of time-course change of throttle opening T, engine speed N, pitch angle θ, and navigation speed V. Change of current engine speed N and navigation speed V in a case where pitch angle θ is fixed at a predetermined value is shown in FIG. 19 as a comparative example (characteristics A5 and A6). In the example of FIG. 19, the throttle lever 67 is initially in neutral position. Therefore, desired throttle opening Ta and desired throttle opening Ta are both 0 (see FIG. 16), initial throttle opening T is 0(%) as indicated by characteristic A1, engine speed N is engine idle speed Ni (e.g., 600 to 700 rpm) as indicated by characteristic A2, pitch angle θ is 0° as indicated by characteristic A3, and navigation speed V is 0 (km/h) as indicated by characteristic A4.

When from this state the throttle lever 67 is wide-opened for rapid acceleration at time t1, the rapid acceleration intention detection unit 504 detects a rapid acceleration intention and the ECU 50 begins acceleration control. In this case, pitch angle θ is first controlled to 0, as indicated by characteristic A3, in order to reduce load on the engine 15 (S21), and in addition, as indicated by characteristic A1, throttle opening T is controlled to maximum throttle opening Tmax (100%) (S22). Thus, with load due to rotation of the propeller 23 at minimum, throttle opening T is instantaneously raised to maximum, so that engine speed N rises steeply from engine idle speed Ni as indicated by characteristic A2.

When engine speed N reaches the desired engine speed Na, namely, maximum engine speed Nmax (e.g., 6,000 rpm), at time t2, the ECU 50 gradually increases pitch angle from 0° (S24). So the propeller 23 generates propulsion, and navigation speed V gradually increases as indicated by characteristic A4. As pitch angle θ is increased after raising engine speed N to the desired engine speed Na, response of navigation speed V to change of pitch angle θ is good and acceleration performance of the boat 1 can be enhanced.

In contrast, when pitch angle θ is kept fixed at occurrence of a rapid acceleration command, load owing to rotation of the blades of the propeller 23 rises sharply, so that rate of engine speed N increase is low, as indicated by characteristic A5 (dotted line). As a result, as indicated by characteristic A6 (dotted line), rate of navigation speed V increase is also low and good acceleration performance cannot be achieved.

When, after start of acceleration control, pitch angle θ reaches the maximum pitch angle θ1 at time t3 (characteristic f3), the ECU 50 terminates acceleration control and implements ordinary control (S26). In the example of FIG. 19, the throttle lever 67 is manipulated to maximum at the time of a rapid acceleration command, so that throttle opening T is maintained at maximum throttle opening Tmax and pitch angle θ at maximum pitch angle θ1, and the boat 1 navigates at maximum navigation speed.

Figure 20:
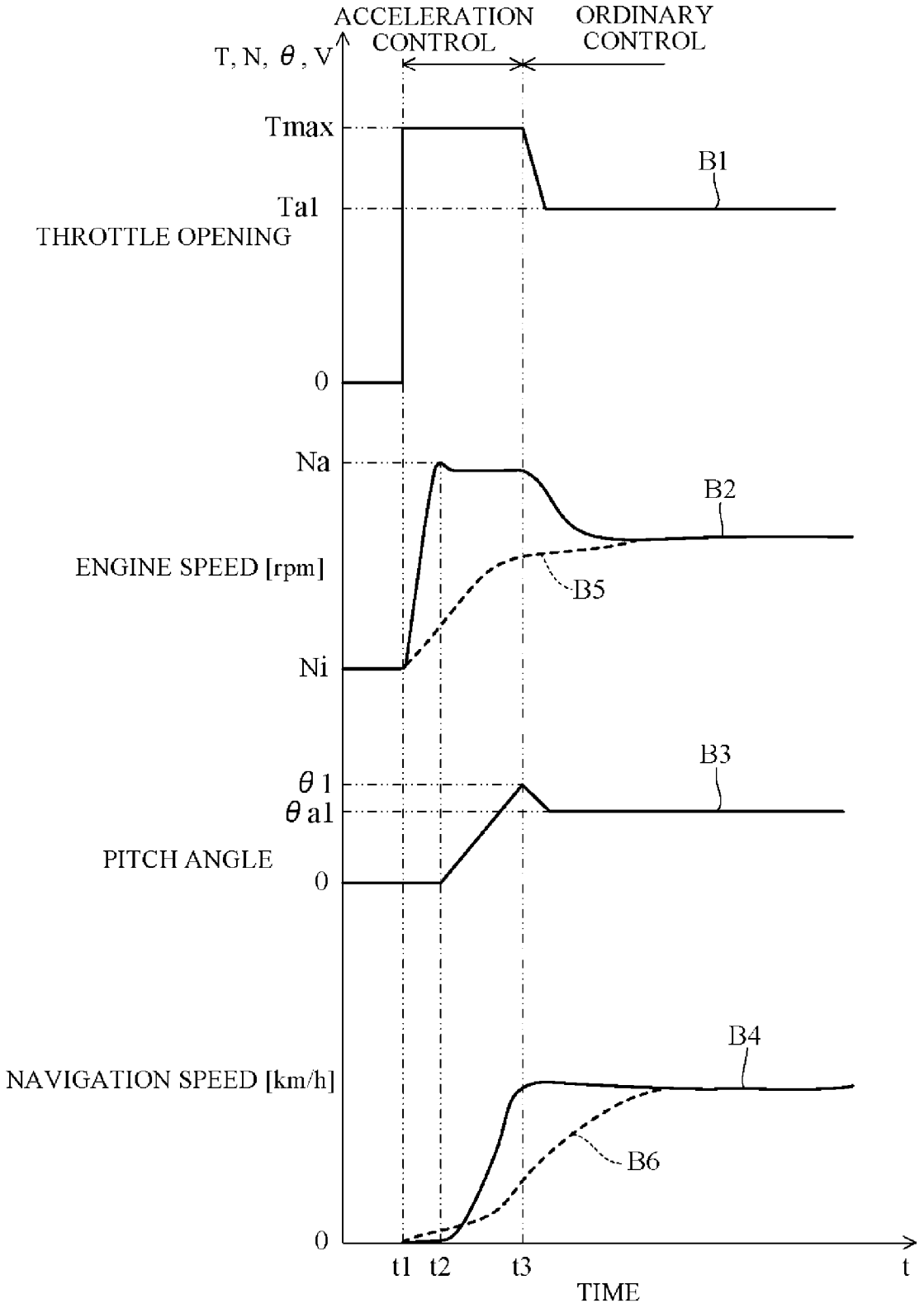
FIG. 20 is a time chart, similar to FIG. 19, but showing a case of rapid acceleration operation of the throttle lever out of neutral position.

FIG. 20 is a time chart for the case of rapid acceleration operation of the throttle lever 67 out of neutral position by the predetermined amount Sa (see FIG. 16) smaller than maximum operation amount, wherein characteristics of throttle opening T, engine speed N, pitch angle θ and navigation speed V are represented by B1 to B4. In the acceleration control section of FIG. 20, throttle opening T, engine speed N, pitch angle θ and navigation speed V change similarly to in FIG. 19. Therefore, rate of increase of engine speed N (characteristic B2) is greater than when accelerating with pitch angle θ kept fixed (characteristic B5) and increase rate of navigation speed V is also greater than when accelerating with pitch angle θ kept fixed (characteristic B6).

When ordinary control is started at time t3 of FIG. 20 (S26), throttle opening T is controlled to a desired throttle opening Ta1 commensurate with operation amount S of the throttle lever 67 and pitch angle θ is controlled to a desired pitch angle θa1 commensurate with operation amount S of the throttle lever 67. At this time, engine speed N assumes a smaller value than the predetermined engine speed Na (e.g., 4,000 rpm).

As stated above, the third embodiment is configured such that the apparatus further includes: a rapid acceleration intention detection unit (504) configured to detect an intention of rapid acceleration made by the operator through operation of the throttle lever; and an engine speed detector (rotation pulse sensor 53) configured to detect an engine speed of the engine; and the throttle control unit (501) increases the throttle opening T of the engine to a predetermined opening (e.g., Tmax) when the rapid acceleration intention is detected by the rapid acceleration intention detection unit; and the pitch angle control unit (502) controls the pitch angle θ of the propeller to a engine load minimizing angle θmin that minimizes a load acting on the engine (S21), and increases the pitch angle θ from the engine load minimizing angle θmin to a predetermined pitch angle θ1 when an increase of the engine speed N to a predetermined speed Na is detected by the engine speed detector (S23 to S25).

With this, by controlling the pitch angle θ to the engine load minimizing angle θmin and by increasing the throttle opening T of the engine to the predetermined opening (e.g., Tmax) when the rapid acceleration intention is detected, it becomes possible to increase the engine speed N to the predetermined speed Na quickly. As a result, after that, by increasing the pitch angle θ, it becomes possible to increase the navigation speed V rapidly, enabling to improve acceleration performance of the boat 1.

In the apparatus, the pitch angle control unit (502) increases the pitch angle θ from the engine load minimizing angle θmin to the predetermined pitch angle θ1 gradually when the increase of the engine speed N to the predetermined speed Na is detected by the engine speed detector after the rapid acceleration intention was detected by the rapid acceleration intention detection unit (S24).

With this, by increasing the pitch angle θ gradually, it becomes possible to prevent a sudden engine load increase and to achieve a good acceleration even when the predetermined engine speed Na is set to be lower than the maximum engine speed Nmax.

In the apparatus, the throttle control unit (501) controls the throttle opening of the engine based on the operation amount S of the throttle lever 67 when the pitch angle θ has been increased to the predetermined pitch angle by the pitch angle control unit (502), and the pitch angle control unit (502) controls the pitch angle θ based on the operation amount S of the throttle lever (S26).

With this, it becomes possible to control the throttle opening T and pitch angle θ to values, for example, that improve fuel consumption during ordinary control after termination of the acceleration control.

In the apparatus, the predetermined opening of the throttle opening is a maximum opening and the predetermined pitch angle θ1 of the propeller is a maximum pitch angle.

With this, it becomes possible to achieve the acceleration performance to the maximum and to raise the navigation speed V to a desired speed within a short time.

Fourth Embodiment

Although acceleration performance of the boat 1 was explained in the foregoing third embodiment, the outboard motor 10 requires not only acceleration performance but also good deceleration performance of the boat 1. In a fourth embodiment, therefore, the control apparatus for an outboard motor is configured to enhance deceleration performance. The fourth embodiment of the present invention is explained in the following with reference to FIGS. 21 to 25.

Figure 21:
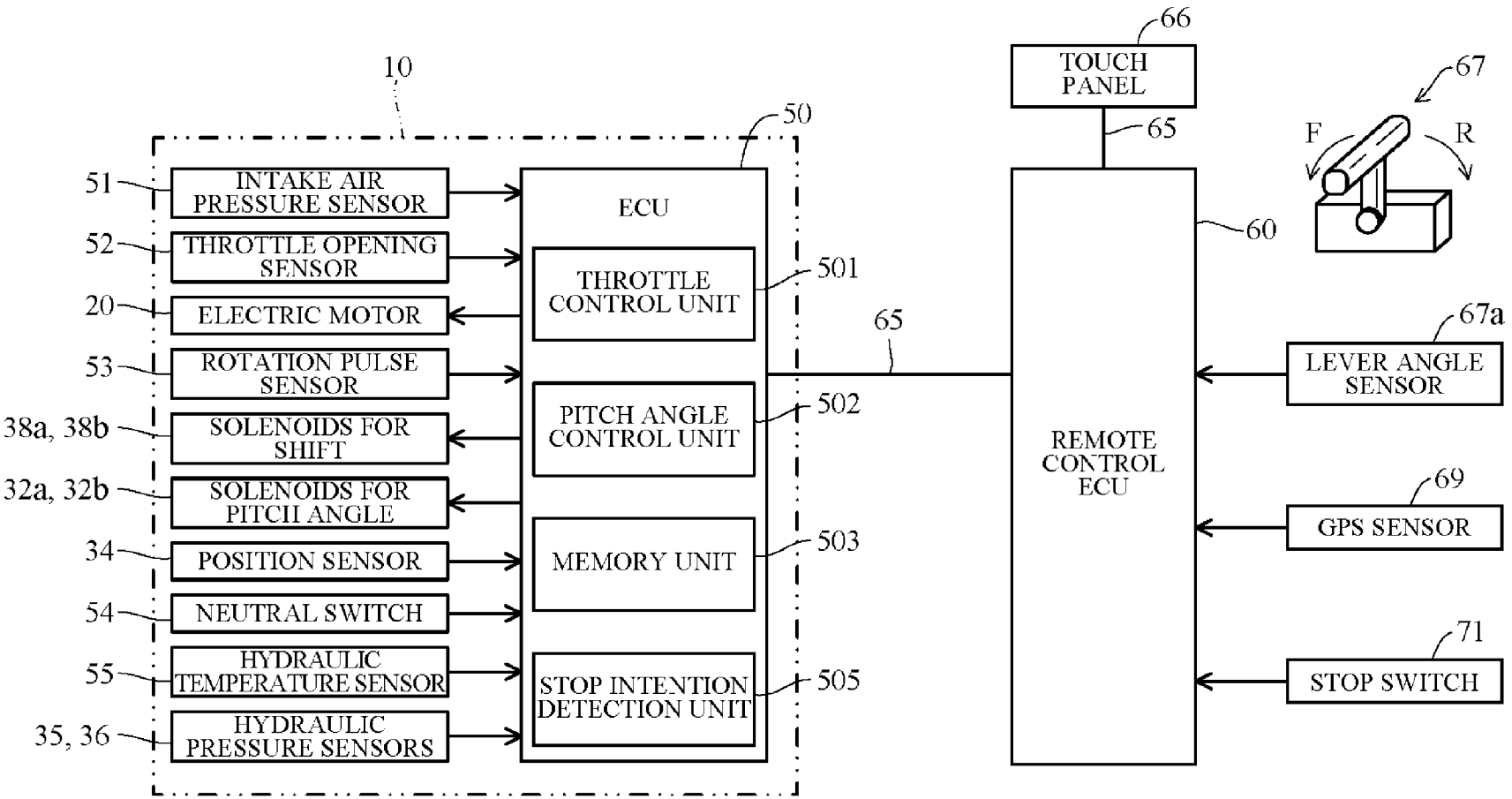
FIG. 21 is a diagram, similar to FIG. 6, but showing a configuration of the outboard motor control apparatus according to the fourth embodiment of the present invention.

FIG. 21 is a block diagram showing a configuration of the outboard motor control apparatus according to the fourth embodiment of the present invention. The control apparatus of FIG. 21 can be configured on the basis of the control apparatus of any of the first embodiment (FIG. 6), second embodiment (FIG. 11) or third embodiment (FIG. 15). An example configured on the basis of the control apparatus of the second embodiment is explained in the following. In FIG. 21, portions like those in FIG. 11 are assigned the same symbols as those in FIG. 11.

As shown in FIG. 21, the ECU 50 has as functional constituents the throttle control unit 501, the pitch angle control unit 502, the memory unit 503, and a stop intention detection unit 505. The stop intention detection unit 505 detects intention of the boat operator to stop the boat 1, i.e., stop intention.

The remote control ECU 60 receives signal inputs not only from the touch panel 66, lever angle sensor 67*a* and GPS sensor 69 but also from a stop switch 71, and these signals are all transmitted from the remote control ECU 60 to the ECU 50 through the digital communication line 65. The stop switch 71 is installed in the cockpit (not shown in FIG. 1) and is made operable by the boat operator to input an intention to stop the boat 1. The mode selector 70 is omitted in FIG. 21, and operation mode is fixed in a predetermined mode (e.g., fuel efficiency priority mode). Relationship between operation amount S of the throttle lever 67 and each of desired throttle opening Ta and desired pitch angle θa is the same as that shown in FIG. 16, for example.

Figure 22:
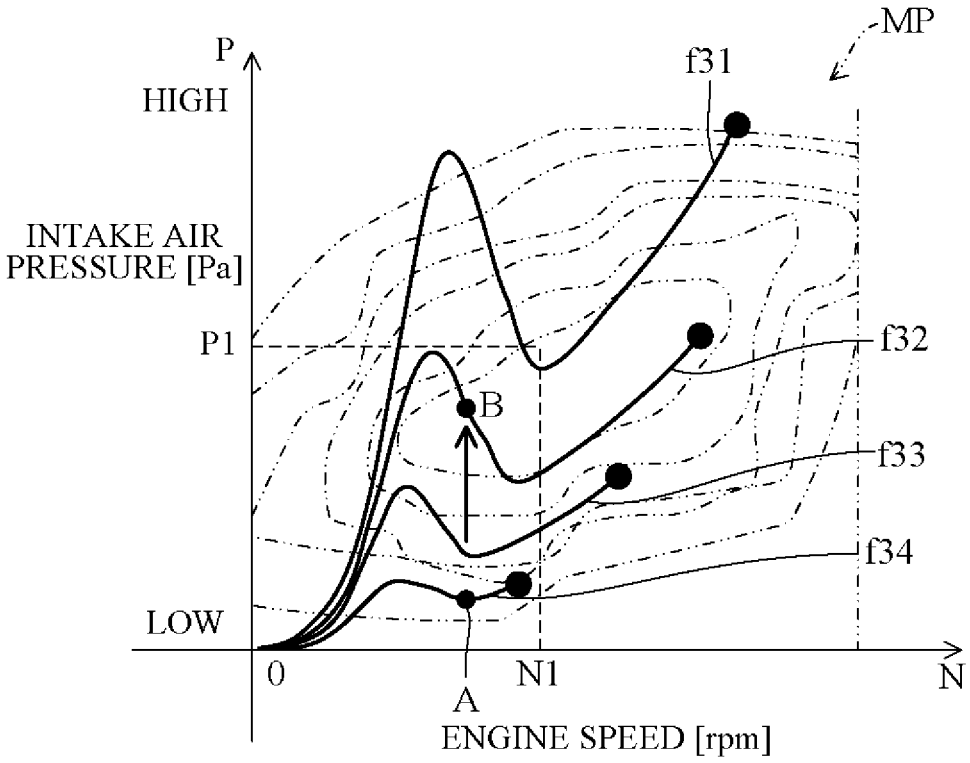
FIG. 22 is a diagram showing an example of a fuel consumption map.

FIG. 22 is an example of a fuel consumption map MP. Engine speed N (unit: rpm) is plotted on horizontal axis and intake air pressure P (unit: Pa) on vertical axis in FIG. 22.

Also shown in FIG. 22 are running performance curves (characteristics f31 to f34) indicating relation of load (intake air pressure P) to engine speed N. The characteristics f31, f32, f33 and f34 are running performance curves at pitch angles θ of 5°, 10°, 15° and 20°. In all of the characteristics f31 to f34, load P once peaks prior to planing (state of speeding hull gliding on top of water). Comparing the characteristics f31 to f34, load P is seen to be higher in proportion as pitch angle θ is greater, which is because distance advanced by the boat 1 during one rotation of the propeller 23 increases.

Of note here is that when the forward-navigating boat 1 is to be stopped, braking force can be increased and braking distance shortened by changing pitch angle θ from positive value to negative value to generate propulsion in reverse direction, i.e., opposite from forward direction. However, when the reverse direction pitch angle θ is too large, load acting on the engine 15 rises (see FIG. 22). As a result, the engine 15 is in danger of being stopped (stalled) owing to load exceeding engine 15 output (torque). On the other hand, when reverse direction pitch angle θ is small, load increase can be held down but braking distance becomes longer in proportion. In the fourth embodiment, therefore, the control apparatus for an outboard motor is configured as set out below in order to shorten braking distance while avoiding engine stalling when a stopping operation of the boat 1 is performed.

Figure 23:
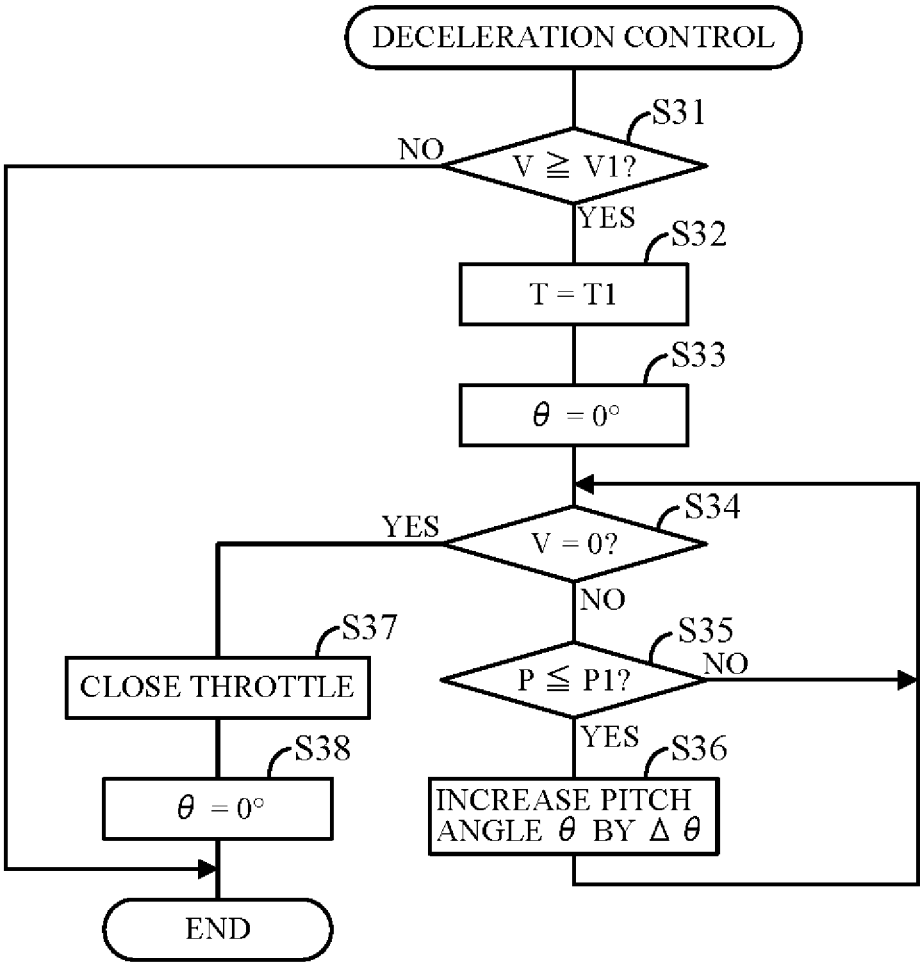
FIG. 23 is a flowchart, similar to FIG. 9, but showing operation of the outboard motor control apparatus according to the fourth embodiment.

FIG. 23 is a flowchart showing an example of processing performed by the ECU 50, particularly processing related to deceleration control. The processing shown in this flowchart is commenced when, during navigation of the boat 1 under ordinary control in accordance with predetermined characteristics fΓ and f0 (FIG. 16), for example, stopping of the boat 1 is instructed by the boat operator operation and the stop intention detection unit 505 detects the boat operator's intention to stop.

The instruction to stop the boat 1 is inputted by operation of the stop switch 71 or operation of the throttle lever 67 from forward range ΔF to reverse range ΔR (lever stop operation). Therefore, the stop intention detection unit 505 detects occurrence or not of stop switch 71 operation by a signal from the stop switch 71 and discriminates occurrence or not of lever stop operation by a signal from the lever angle sensor 67*a*. And upon either of the operations being made, it ascertains stop intention of the boat operator and commences the deceleration control of FIG. 23.

First, in S31, output from the GPS sensor 69 is read and it is discriminated whether navigation speed V is equal to or greater than a prescribed speed V1. The prescribed speed V1 is defined with consideration to possibility of engine stalling when pitch angle θ is changed from positive to negative. Since inertial force of the boat 1 increases with increasing navigation speed V, load at the time of stopping operation becomes large and engine stalling is more likely to occur. Alternatively, a highly probable minimum navigation speed of the boat 1 can be determined in advance, empirically, for example, and this be defined as the prescribed speed V1. When the result in S31 is NO, deceleration control is terminated because probability of engine stalling during stopping operation is nil or minimal.

On the other hand, when the result in S31 is YES, the program goes to S32, in which processing is performed in the throttle control unit 501 by which a control signal is outputted to the electric motor 20, thereby controlling throttle opening T to a prescribed throttle opening T1. The prescribed throttle opening T1 is smaller than throttle opening T when the boat 1 is navigating at or faster than the prescribed speed V1. Therefore, in S32, throttle opening T is constricted to the prescribed throttle opening T1.

The prescribed throttle opening T1 is defined as a function of a predetermined desired engine speed Na so as to make engine speed N become the desired engine speed Na during deceleration control. The desired engine speed Na is defined with consideration to possibility of engine stalling during stopping operation (when pitch angle θ is changed to negative) and also to strength of the blades of the propeller 23, namely, to risk of engine stalling owing to increased load during stopping operation when the desired engine speed Na is low. On the other hand, when the desired engine speed Na is large, the blades of the propeller 23 are susceptible to breakage owing to occurrence of heavy stress occurring in the blades of the propeller 23. With these points in mind, desired engine speed Na is defined in the range of 2,000 rpm to 3,000 rpm, for example.

Next, in S33, processing is performed by the pitch angle control unit 502 by which control signals are outputted to the solenoids 32*a* and 32*b* of the direction switching valve 32 for pitch angle adjustment to control pitch angle to 0°. This makes forward direction propulsion of the boat 1 zero. Next, in S34, output from the GPS sensor 69 is read and it is discriminated whether the boat 1 is stopped, i.e., whether navigation speed V is 0. When the result in S34 is NO, the program goes to S35.

In S35, output from the intake air pressure sensor 51 is read and it is discriminated whether intake air pressure P is equal to or less than a predetermined value P1. The predetermined value P1 is defined with consideration to output (torque) of the engine 15 when engine speed N is the desired engine speed Na. For example, intake air pressure P corresponding to engine output or a value obtained by multiplying this intake air pressure P by a predetermined safety factor is defined as predetermined value P1. When the result in S35 is NO, the program goes back to S34.

On the contrary, when the result in S35 is YES, the program goes to S36, in which processing is performed by the pitch angle control unit 502 by which control signals are outputted to the solenoids 32*a* and 32*b* to increase pitch angle θ by a predetermined angle Δθ (e.g., 1°) toward the negative side. In other words, engine output has some leeway with respect to load when intake air pressure P is equal to or less than the predetermined value P1, so load is increased by expanding reverse direction pitch angle θ. Next, the program goes back to S34 and repeats the same processing. Thus, insofar as P≤P1 is satisfied, negative side pitch angle θ grows gradually larger and braking force increases.

When navigation speed V is discriminated to be 0 in S34, the program goes to S37. In S37, processing is performed by the throttle control unit 501 by which a control signal is outputted to the electric motor 20 to make throttle opening T zero, i.e., to close the throttle valve 19. Next, in S38, processing is performed by the pitch angle control unit 502 by which control signals are outputted to the solenoids 32*a* and 32*b* to restore pitch angle θ to 0°. This concludes the deceleration control.

Operation of the control apparatus for an outboard motor according to the fourth example will be explained in concrete detail.

Figure 24:
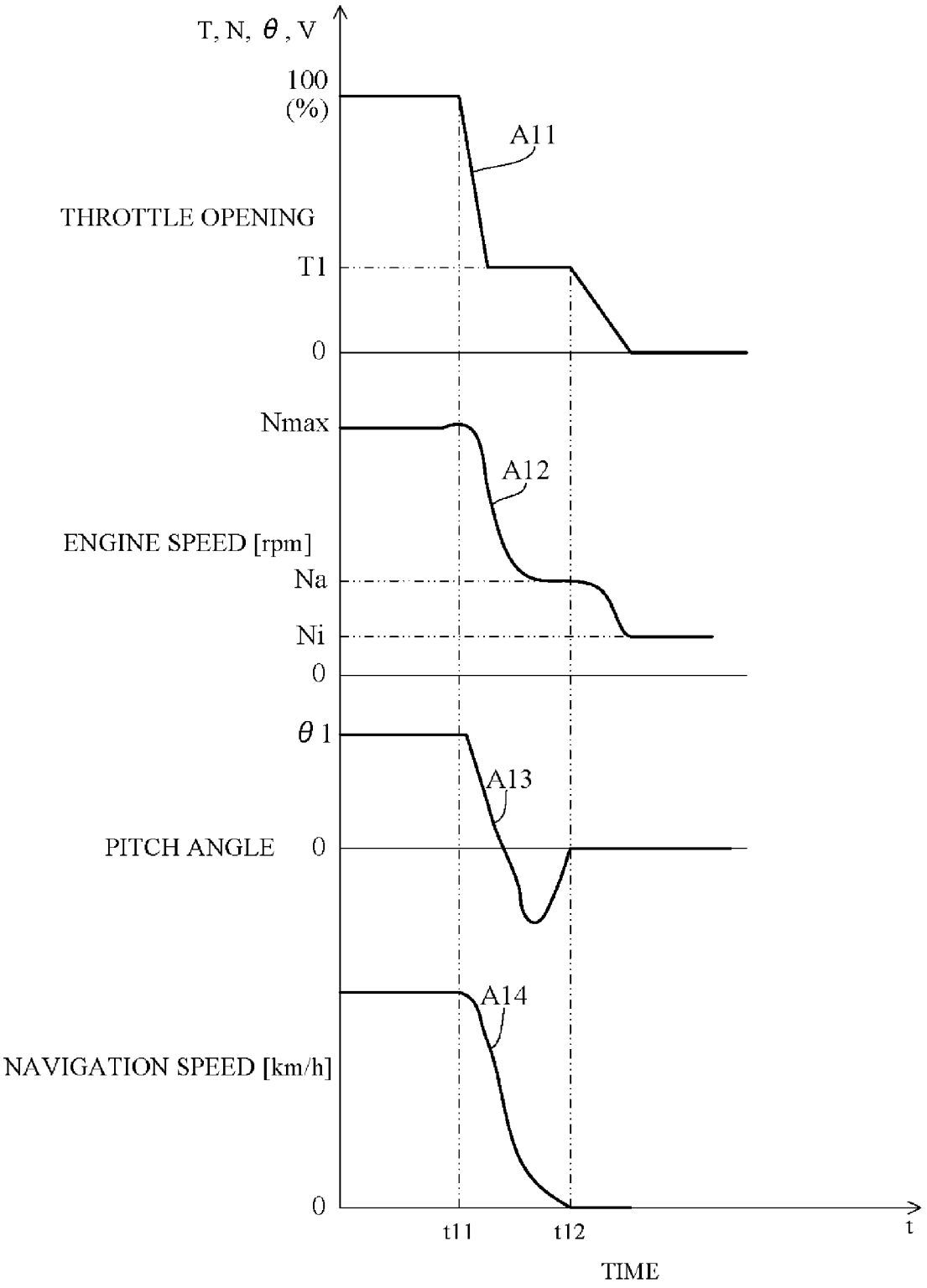
FIG. 24 is a time chart showing an example of time-course change of throttle opening, engine speed, pitch angle, and navigation speed.

FIG. 24 is a time chart showing an example of time-course change of throttle opening T, engine speed N, pitch angle θ, and navigation speed V. In the example of FIG. 24, initially the throttle lever 67 is in a state fully operated in forward range μF and lever operation amount S is maximum. Therefore, desired throttle opening Ta and desired pitch angle θa are both maximum (see FIG. 16), initial throttle opening T is 100(%) as indicated by characteristic A11, engine speed N is maximum engine speed Nmax (e.g., 6,000 rpm) as indicated by characteristic A12, pitch angle θ is positive-side maximum pitch angle θ1 as indicated by characteristic A13, and navigation speed V is maximum as indicated by characteristic 14.

When from this state the stop switch 71 is operated or the throttle lever 67 is operated from forward range ΔF to reverse range ΔR at time t11, the stop intention detection unit 505 detects the boat operator's intention to stop, and the ECU 50 begins deceleration control. In this case, throttle opening T is first constricted to the predetermined throttle opening T1 (S32) and pitch angle θ is reduced to 0° (S33). Thus, engine speed N falls to the desired engine speed Na and the boat 1 decelerates as indicated by characteristics A12 and A14.

In a 0° state of pitch angle θ, if intake air pressure P (load) detected by the intake air pressure sensor 51 is at or less than the predetermined value P1, pitch angle θ is gradually increased to the negative-side predetermined angle Δθ (S36). Thus, as shown in FIG. 22, when, for example, pitch angle θ is 5° (characteristic f34; point A), pitch angle increases gradually to 10° (characteristic f33) and 15° (characteristic f32), and relationship between engine speed N and intake air pressure P changes from point A to point B in FIG. 22. In FIG. 22, the region of engine speed N at or below a predetermined value N1 and intake air pressure P at or below the predetermined value P1 is a zone of increasing pitch angle θ, and amount of negative-side pitch angle θ increase is regulated so as not to go beyond of this zone. The predetermined value N1 is, for example, maximum value of the desired engine speed Na (e.g., 3,000).

When negative-side (reverse-side) pitch angle θ is gradually increased in this manner, propulsion of the boat 1 rises and the boat 1 rapidly decelerates. Therefore, braking distance during stopping operation of the boat 1 can be held down. Moreover, since pitch angle θ increases when intake air pressure P is at or below the predetermined value P1, engine stalling during stopping operation can be prevented because a load greater than engine output can be prevented from acting on the engine 1.

When navigation speed V becomes 0 at time t12 in FIG. 24, throttle opening T is closed and pitch angle θ is controlled to 0° (S37, S38). As a result, engine speed N becomes engine idle speed Ni and the boat 1 maintains a stopped condition of navigation speed V=0.

Figure 25:
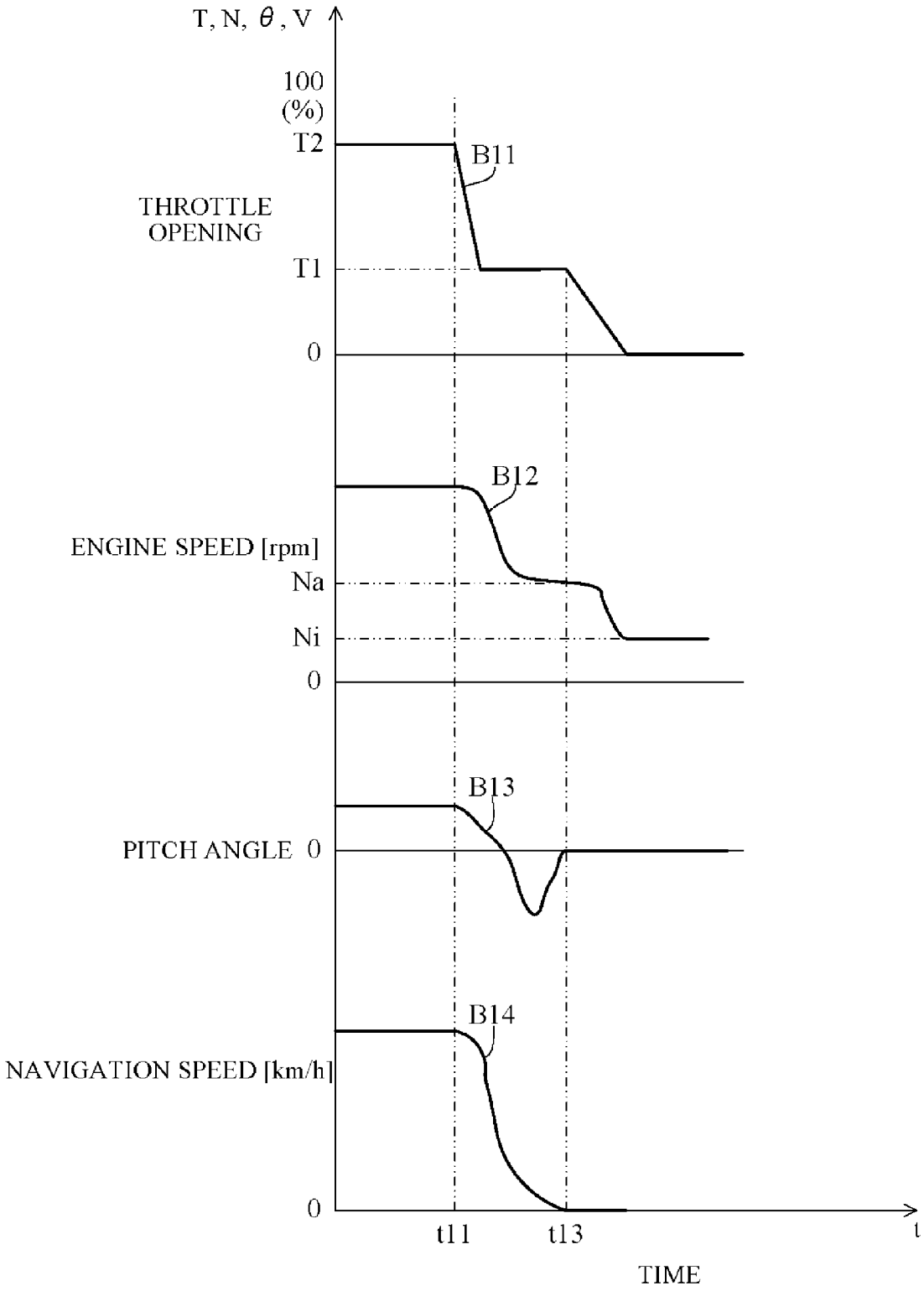
FIG. 25 is a diagram showing a modification on the example of FIG. 24.

FIG. 25 is a diagram showing a modification on the example of FIG. 24. Characteristics B11 to B14 of FIG. 25 correspond to characteristics A11 to A14 of FIG. 24. FIG. 25 shows an operation when a stopping operation is performed by the boat operator from a forward navigating state of the boat 1 by, in the initial state, controlling throttle opening T to a value T2 that is smaller than wide-open and larger than the predetermined throttle opening T1. Although throttle opening T, engine speed N, pitch angle θ and navigation speed V in the initial state are smaller than those in FIG. 24, once stop intention is detected at time t11, the characteristics B11 to B14 change to a pattern like in FIG. 24 and navigation speed V becomes 0 at time t13.

As stated above, the fourth embodiment is configured such that the apparatus further includes: an engine load detector (51) configured to detect an engine load (intake air pressure P) acting on the engine (15); and a boat stop intention detection unit (505) configured to detect an intention of the operator to stop the boat (1) when navigated in a first (forward) direction; and the throttle control unit (501) controls the throttle opening T of the engine to a prescribed opening T1 when the boat stop intention is detected by the boat stop intention detection unit (S32); and the pitch angle control unit (502) controls the pitch angle of the propeller to make propulsion of the boat (1) in the first direction decrease when the boat stop intention is detected by the boat stop intention detection unit, and controls the pitch angle of the propeller to make propulsion of the boat (1) to a second (reverse) direction that is opposite in the first direction increase when the engine load detected by the engine load detector is equal to or smaller than a predetermined load (S33 to S36).

With this, by controlling the throttle opening T to the prescribed opening T1 and by decreasing the pitch angle θ (e.g., to zero) when detecting stop intention, and then by increasing the same in the minus direction when the engine load (intake air pressure P) is equal to or smaller than the predetermined load (P1), it becomes possible to prevent engine stalling condition and to shorten braking distance of the boat 1, thereby enabling to stop the boat 1 effective in a short time.

The apparatus further includes: a navigation speed detector (GPS sensor 69) configured to detect the navigation speed of the boat 1; and the throttle control unit (501) and the pitch angle control unit (502) control the throttle opening T of the engine and the pitch angle θ of the propeller when the navigation speed V of the boat 1 is equal to or greater than a prescribed navigation speed V1.

Thus, by controlling the throttle opening T to the prescribed opening T1 when the navigation speed V is relatively high (S32) and by controlling the pitch angle θ to 0° (S33) and then by controlling the pitch angle θ to the minus direction (S36), it becomes possible to stop the boat 1 moderately at a low speed as desired during navigation.

In the apparatus, the throttle control unit (501) closes the throttle valve (19) and the pitch angle control unit (502) controls the pitch angle θ of the propeller to make propulsion of the boat (1) in the first direction and the second direction decrease if stop of the boat 1 is detected by the navigation speed detector when the throttle opening T is controlled to the prescribed opening by the throttle control unit and the pitch angle θ of the propeller is controlled to make propulsion of the boat (1) in the second direction increase (S37, S38).

With this, it becomes possible to stably maintain a condition under which the navigation speed V is zero.

In the apparatus, the boat stop intention detection unit (505) includes a stop switch (71) configured to be operable by the operator to input an intention to stop boat (1) and detects the intention of the operator to stop the boat (1) from the input of the stop switch. With this, it becomes possible to make the configuration simple.

In the apparatus, the throttle lever (67) is made operable at a first range (ΔF) that allows the operator to input an intention to move the boat in the first direction and at a second range (ΔR) that allows the operator to input an intention to move the boat (1) in the second direction, the first range and the second range sandwiching a neutral position (ΔN) therebetween; and the boat stop intention detection unit (505) detects the intention of the operator to stop the boat (1) based on the operation amount of the throttle lever detected by the throttle lever operation amount detector (lever angle sensor 67*a*).

With this, since the boat stop intention is detected when the throttle lever 67 is operated beyond the neutral position, it becomes possible to detect the boat stop intention of the operator surely.

In the above, it should be noted that the configurations of the first to fourth embodiments are examples and should not be limited thereto. For example, the memory unit 503 can be provided not in the outboard motor 10, but in the remote control ECU 60, for example. The operation modes can not be limited to the three acceleration modes A to C and can be increased or decreased. The detector sensors should not be limited to those disclosed in the embodiments.

While the invention has thus been shown and described with reference to a specific embodiment, it should be noted that the invention is in no way limited to the details of the described arrangement; changes and modifications may be made without departing from the scope of the appended claims.

What is claimed is:

1. An apparatus for controlling an outboard motor mounted on a hull of a boat and having an internal combustion engine, a throttle lever configured to be manipulated by an operator to regulate a throttle opening of a throttle valve of the engine, and a propeller powered by the engine, the propeller being a variable pitch propeller whose pitch angle is made variable, comprising:

a throttle lever operation amount detector configured to detect an operation amount of the throttle lever;

a memory unit configured to memorize characteristics defining a desired throttle opening of the engine and a desired pitch angle of the propeller that make fuel consumption minimum relative to the operation amount of the throttle lever;

a throttle control unit configured to control the throttle opening of the engine to the desired throttle opening based on the operation amount of the throttle lever detected by the throttle lever operation amount detector in accordance with the characteristics memorized by the memory unit;

a pitch angle control unit configured to control the pitch angle of the propeller to the desired pitch angle based on the operation amount of the throttle lever detected by the throttle lever operation amount detector in accordance with the characteristics memorized by the memory unit; and a mode selector configured to be operable by the operator to select one among operation modes including a fuel consumption priority mode that is given priority to the fuel consumption, a navigation speed priority mode that is given priority to time economy than fuel consumption, and a boat steerability priority mode that is given priority to boat steerability in a course steering of the boat during casting off and docking;

wherein the memory unit memorizes characteristics of the operation modes defining the desired throttle opening of the engine and the desired pitch angle of the propeller relative to the operation amount of the throttle lever, the characteristics being different between different ones of the operation modes;

wherein the throttle control unit controls the throttle opening of the engine to the desired throttle opening based on the operation amount of the throttle lever in accordance with the characteristics of the one among the operation modes selected by the mode selector and memorized by the memory unit; and wherein the pitch angle control unit controls the pitch angle of the propeller to the desired pitch angle based on the operation amount of the throttle lever in accordance with the characteristics of the one among the operation modes selected by the mode selector and memorized by the memory unit.

2. The apparatus according to claim 1, wherein:

the throttle control unit makes the throttle opening of the engine greater when the navigation speed priority mode is selected than when the fuel consumption priority mode is selected; and the pitch angle control unit controls the pitch angle of the propeller to decrease when the navigation speed priority mode is selected than when the fuel consumption priority mode is selected.

3. The apparatus according to claim 1, wherein:

the throttle control unit decreases the throttle opening of the engine when the boat steerability priority mode is selected than when the fuel consumption priority mode is selected; and the pitch angle control unit decreases the pitch angle of the propeller when the boat steerability priority mode is selected than when the fuel consumption priority mode is selected.

4. The apparatus according to claim 1, further including:

a rapid acceleration intention detection unit configured to detect an intention of rapid acceleration made by the operator through operation of the throttle lever; and an engine speed detector configured to detect an engine speed of the engine; and the throttle control unit increases the throttle opening of the engine to a predetermined opening when the rapid acceleration intention is detected by the rapid acceleration intention detection unit; and the pitch angle control unit controls the pitch angle of the propeller to an engine load minimizing angle that minimizes a load acting on the engine, and increases the pitch angle from the engine load minimizing angle to a predetermined pitch angle when an increase of the engine speed to a predetermined speed is detected by the engine speed detector.

5. The apparatus according to claim 4, wherein the pitch angle control unit increases the pitch angle from the engine load minimizing angle to the predetermined pitch angle gradually when the increase of the engine speed to the predetermined speed is detected by the engine speed detector after the rapid acceleration intention was detected by the rapid acceleration intention detection unit.

6. The apparatus according to claim 4, wherein the throttle control unit controls the throttle opening of the engine based on the operation amount of the throttle lever when the pitch angle has been increased to the predetermined pitch angle by the pitch angle control unit, and the pitch angle control unit controls the pitch angle based on the operation amount of the throttle lever.

7. The apparatus according to claim 4, wherein the predetermined opening of the throttle opening is a maximum opening and the predetermined pitch angle of the propeller is a maximum pitch angle.

8. The apparatus according to claim 1, further including:

an engine load detector configured to detect an engine load acting on the engine; and a boat stop intention detection unit configured to detect an intention of the operator to stop the boat when navigated in a first direction; and the throttle control unit controls the throttle opening of the engine to a prescribed opening when the boat stop intention is detected by the boat stop intention detection unit; and the pitch angle control unit controls the pitch angle of the propeller to make propulsion of the boat in the first direction decrease when the boat stop intention is detected by the boat stop intention detection unit, and controls the pitch angle of the propeller to make propulsion of the boat to a second direction that is opposite in the first direction increase when the engine load detected by the engine load detector is equal to or smaller than a predetermined load.

9. The apparatus according to claim 8, further including:

a navigation speed detector configured to detect the navigation speed of the boat; and the throttle control unit and the pitch angle control unit control the throttle opening of the engine and the pitch angle of the propeller when the navigation speed of the boat is equal to or greater than a prescribed navigation speed.

10. The apparatus according to claim 9, wherein the throttle control unit closes the throttle valve and the pitch angle control unit controls the pitch angle of the propeller to make propulsion of the boat in the first direction decrease if stop of the boat is detected by the navigation speed detector when the throttle opening is controlled to the prescribed opening by the throttle control unit and the pitch angle of the propeller is controlled to make propulsion of the boat in the second direction increase.

11. The apparatus according to claim 8, wherein the boat stop intention detection unit includes a stop switch configured to be operable by the operator to input an intention to stop boat and detects the intention of the operator to stop the boat from the input of the stop switch.

12. The apparatus according to claim 8, wherein the throttle lever is made operable at a first range that allows the operator to input an intention to move the boat in the first direction and at a second range that allows the operator to input an intention to move the boat in the second direction, the first range and the second range sandwiching a neutral position therebetween; and the boat stop intention detection unit detects the intention of the operator to stop the boat based on the operation amount of the throttle lever detected by the throttle lever operation amount detector.

* * * * *